US008534167B2

(12) United States Patent
Liu

(10) Patent No.: US 8,534,167 B2
(45) Date of Patent: Sep. 17, 2013

(54) SUPER HIGH-TORQUE OPEN END WRENCH CAPABLE OF FAST DRIVING

(76) Inventor: Wen-Pin Liu, Taichung (TW)

( * ) Notice: Subject to any disclaimer, the term of this patent is extended or adjusted under 35 U.S.C. 154(b) by 415 days.

(21) Appl. No.: 12/957,498

(22) Filed: Dec. 1, 2010

(65) Prior Publication Data

US 2011/0277600 A1 Nov. 17, 2011

(30) Foreign Application Priority Data

May 11, 2010 (TW) ..... 99114970 A

(51) Int. Cl.
*B25B 13/46* (2006.01)
*B25B 13/08* (2006.01)

(52) U.S. Cl.
USPC ..... 81/179; 81/186

(58) Field of Classification Search
USPC ..... 81/179, 186, 128, 60, 90.1, 90.2
See application file for complete search history.

(56) References Cited

U.S. PATENT DOCUMENTS

| | | | | |
|---|---|---|---|---|
| 365,019 | A | 6/1887 | Phillips | 81/179 |
| 385,595 | A | 7/1888 | Chappell | 81/179 |
| 1,320,668 | A | 11/1919 | Askman | 81/179 |
| 2,797,600 | A | 7/1957 | Beaver | 81/179 |
| 3,641,847 | A | 2/1972 | Horton | 81/111 |
| 3,695,125 | A | 10/1972 | Glass et al. | 81/179 |
| 4,158,975 | A | 6/1979 | DeSousa | 81/179 |
| 4,706,528 | A | 11/1987 | Inoue | 81/179 |
| 4,889,020 | A | 12/1989 | Baker | 81/119 |
| 5,287,777 | A | 2/1994 | Kolodziej | 81/179 |
| 7,024,971 | B2 | 4/2006 | Stanton | 81/179 |
| 7,111,529 | B2 | 9/2006 | Pradelski | 81/179 |
| 7,827,887 | B2 * | 11/2010 | Lee | 81/179 |
| 7,878,095 | B2 * | 2/2011 | Wu | 81/179 |
| 8,342,064 | B2 * | 1/2013 | Lin | 81/179 |
| 2008/0066585 | A1 | 3/2008 | Chiang | 81/125.1 |
| 2009/0044666 | A1 | 2/2009 | Xinhong | 81/92 |
| 2009/0193941 | A1 | 8/2009 | Chiu et al. | 81/165 |
| 2009/0217790 | A1 * | 9/2009 | Harter | 81/186 |
| 2010/0071516 | A1 | 3/2010 | Wu | 81/176.1 |
| 2010/0083797 | A1 | 4/2010 | Lee | 81/60 |
| 2010/0147115 | A1 | 6/2010 | Lee | 81/60 |
| 2011/0265613 | A1 * | 11/2011 | Hu | 81/179 |
| 2011/0277599 | A1 * | 11/2011 | Liu | 81/179 |

* cited by examiner

*Primary Examiner* — Hadi Shakeri
(74) *Attorney, Agent, or Firm* — Alan Kamrath; Kamrath IP Lawfirm, P.A.

(57) ABSTRACT

An open end wrench includes a jaw portion having first and second jaws. The first jaw includes a sliding groove slideably receiving a slide. When the jaw portion is not engaged with a workpiece, the slide is in a free position. When the jaw portion receives the workpiece but does not drive the workpiece, a buffering space is formed between an abutting end of the guiding slot and a guide fixed in the sliding groove. When the jaw portion drives the workpiece and deforms elastically, the body rotates relative to the workpiece, but the slide does not rotate together with the body due to the buffering space such that the end of the slide remains in surface contact with a face of the workpiece. Also, a buffering angle can be formed between a wrenching face on the slide and the face of the workpiece when the jaw portion receives the workpiece but does not drive the workpiece.

18 Claims, 16 Drawing Sheets

SUPER HIGH-TORQUE OPEN END WRENCH CAPABLE OF FAST DRIVING

BACKGROUND OF THE INVENTION

The present invention relates to a super high-torque open end wrench capable of fast driving and, more particularly, to an open end wrench capable of fast driving a workpiece without the risk of undesired shifting from the workpiece and capable of withstanding super high-torque operation.

U.S. Pat. No. 1,320,668 discloses a wrench including a stationary jaw and a movable jaw slideable along a guide. The movable jaw is forced against an abutment at an outer end of the guide by a spring bearing against the stationary jaw. An end of the spring is received in a bore in the stationary jaw. The other end of the spring is received in another bore in the movable jaw. An intermediate portion of the spring is exposed between the stationary jaw and the movable jaw. When the user intends to tighten or loosen a nut, the wrench is turned in a driving direction, during which operation the movable jaw remains in contact with the abutment. For reengagement of the wrench with the nut, it is necessary only to turn the wrench in the opposite direction, during which operation the movable jaw slides backward against the pressure of the spring and on the edges of the nut. The movable jaw is forced forward again as soon as the bearing surfaces of the stationary and movable jaws are parallel with the sides of the nut. The nut can be tightened or loosened through repeated operations. However, the movable jaw wobbles, because the spring can not maintain the position of the movable jaw in a direction transverse to the sliding direction. Furthermore, the movable jaw is liable to disengage from the guide due to impact or falling to the ground. The spring will disengage from the wrench after disengagement of the movable jaw. Further, the exposed portion of the spring, when compressed by the movable jaw, is liable to bend and, thus, be in friction contact with the end edges of the bores of the stationary and movable jaws, leading to non-smooth compression of the spring or even permanent deformation of the spring. Further, the exposed portion of the spring is apt to be contaminated by oil to which debris easily adheres, hindering movement of the movable jaw.

U.S. Pat. No. 3,695,125 discloses an open end ratchet wrench including a head having a fixed jaw and an opposed pawl support portion. A pawl and a spring are mounted to an inner side of the pawl support portion. The pawl is biased by the spring and slideable between an extended torquing position and a retracted ratcheting position. Two side caps are fixed to two sides of the head to define a space receiving the pawl and the spring and to prevent disengagement of the pawl and the spring. The pawl includes a stop shoulder to prevent the pawl from moving out of the pawl support portion under the action of the spring. However, the side caps may separate from the head when the wrench falls to the ground, causing disengagement of the pawl from the pawl support portion and subsequent falling of the spring. Furthermore, the pawl merely biased by the spring is still liable to wobble, although there are two side caps on opposite sides of the pawl. Further, the spring is liable to shift from its original position due to impingement to or repeated compression of an exposed portion of the spring, causing malfunction of the spring. Further, a gap exists between the side caps and the pawl when the pawl is moved into the space. Oil and debris may enter the gap and adversely affect the compression of the spring and the movement of the pawl.

U.S. Pat. No. 4,706,528 discloses an adjustable wrench including a fixed jaw and an adjustable jaw. In an embodiment, a sliding jaw portion is provided on the fixed jaw. The sliding jaw includes a rectilinearly extending slot through which a pin is extended, preventing disengagement of the sliding jaw. A plate spring is mounted to an inner face of the fixed jaw to bias the sliding jaw outward. A hole is formed in an end wall of the slot and receives a coil spring to bias the sliding jaw inward. Thus, the sliding jaw is movable inward or outward and can be retained in place under action of the plate spring and the coil spring. Such a wrench is particularly suitable for rotating pipes, but not suitable for tightening or loosening fasteners such as bolts, nuts, or the like. Specifically, since a pipe has no plane surfaces and is, thus, difficult to grip, the sliding jaw is moved outward to shorten the distance between the sliding jaw and the adjustable jaw for firmly clamping the pipe to permit tightening or loosening of the pipe. The sliding jaw is returned by moving inward under the action of the coil spring. Furthermore, the pipe causes inward movement of the sliding jaw and will not rotate when the wrench is rotated in a reverse direction. However, the coil spring is redundant when the wrench is utilized on a nut or bolt head that has flat sides. In the case that the wrench drives a nut or bolt head having flat faces in a reverse direction, the nut or bolt head initially permits the sliding jaw to move inward. However, when the jaw moves inward to its innermost position, the spacing between the sliding jaw and the adjustable jaw is still smaller than the spacing between two corners of the nut or bolt head such that the nut or bolt head will be rotated in the reverse direction, which is undesired. This is because the sliding jaw moves rectilinearly along the rectilinearly extending slot along an axis at a relatively small angle to a plane on which the adjusting jaw lies. Further, formation of a hole in the inner face of the fixed jaw for receiving a small screw to position the plate spring and formation of the hole for receiving the coil spring reduce the structural strength of the wrench, such that the wrench can only be utilized in pipes that are hollow and, thus, can exert smaller reactive force (which avoids deformation of the hollow pipes) when the pipes are rotated by the wrench. Further, although the coil spring has an end received in the hole of the sliding jaw, the other end of the coil spring outside of the hole is liable to bend when the spring is compressed, leading to friction at the end edge of the opening of the hole and resulting in non-smooth compression of the spring or even permanent deformation of the spring. Further, the slot is open such that most of the reactive force imparted to the sliding jaw during driving of a pipe or nut is transmitted to and, thus, damages the pin. This is because although the sliding jaw has a plane face in sliding contact with another plane face of the fixed jaw, the plane face of the sliding jaw can not provide guidance for the inward or outward movement of the sliding jaw. As a result, the plane face of the sliding jaw transmits the reactive force to the pin instead of effectively withstanding the torque.

U.S. Pat. No. 7,024,971 discloses an open end ratchet wrench including first and second stationary jaws. The first stationary jaw supports a movable plate. A space is sandwiched between two face plates of the first stationary jaw to accommodate the movable plate. The movable plate includes two angled slots each receiving a pin extending through the space, avoiding disengagement of the movable plate. The wrench further includes a hole receiving a spring that has an end located outside of the hole for biasing the movable plate. Each angled slot of the movable plate includes a short section and a long section at an angle to the short section such that the movable plate can move in two stages each having a rectilinear travel. Although the two-stage movement of the movable plate increases the spacing between the movable plate and the second stationary jaw, the movable plate is liable to get stuck at the intersection of the long and short sections, adversely affecting operation of the wrench in the reverse direction. Furthermore, the spring has an exposed section that is liable to bend when the spring is compressed, leading to friction at the end edge of the opening of the hole and resulting in non-smooth compression of the spring or even permanent deformation of the spring. Further, the angled slots increase the area of the movable plate or the first stationary jaw, resulting in difficulties in reducing the volume of the open end wrench. Thus, the wrench can not be used in a small space. If the area of the movable plate is increased or the first stationary jaw is reduced in size, the short section or the longer section would be exposed outside of the first stationary jaw such that debris is apt to accumulate in the slots, adversely affecting rectilinear movement of the movable plate. Further, since the space is open in both sides, the reaction force imparted to the movable plate during driving of a workpiece is completely transmitted to the pins that can not withstand high torque. As a result, the wrench can not be used in high-torque driving operation.

U.S. Patent Publication No. 2009/0193941 A1 discloses first and second jaws formed on a jaw support. The first jaw can be moved by rotating a worm. The jaw support includes an open track in the form of a slot receiving the second jaw. The jaw support further includes a pin extending through the track. The second jaw includes a rectilinear opening through which the pin extends, preventing the second jaw from disengaging from the jaw support. A biasing member is mounted in the opening of the second jaw to bias the second jaw outward. Since the second jaw includes a single rectilinear opening, a change in the spacing from the second jaw to the first jaw is relatively small such that a workpiece will be rotated when the wrench rotates in a reverse direction not intended to rotate the workpiece. Thus, the first jaw must be movable, and the spacing between the first and second jaws can be adjusted by rotating the worm to avoid joint rotation of the workpiece when the wrench rotates in the reverse direction. However, the wrench of this type includes many elements, and the track, opening, and holes in the elements weaken the wrench. Furthermore, since the track is open, the reaction force imparted to the second jaw during driving of the workpiece is completely transmitted to the pin. Thus, the pin is liable to be damaged. Although the second jaw includes a surface in sliding contact with the jaw support to guide sliding movement of the second jaw, this surface merely transmits the reactive force to the pin instead of effectively withstanding the torque. Further, since the second jaw moves rectilinearly, the opening in the second jaw must be lengthened if it is desired to increase the spacing between the first and second jaws. However, this would expose the opening support such that the opening and the biasing member in the opening would easily be contaminated by oil to which debris adheres easily. Furthermore, operation of the biasing member would be adversely affected, causing non-smooth movement of the second jaw.

The above patents and U.S. Pat. No. 4,158,975 as well as U.S. Patent Publication Nos. 2008/0066585 A1; 2010/0071516 A1; and 2010/00873797 A1 have a common disadvantage. Specifically, the open end wrench has a limited torque-bearing capacity. This is because the open end wrench expands elastically under excessive torque. As an example, when the user finds that the torque applied is insufficient, an elongated metal tube will be coupled to the handle to increase the arm of force for large-torque operation. However, the reactive force will be larger than the elastic deforming capacity when the fastener is tightened to an extent, leading to elastic expansion in the jaws that hold the fastener during the driving operation. Thus, the jaws can not effectively hold the fastener, leading to disengagement of the movable jaw from the engaged sides of the fastener. The corners of the fastener wear easily, resulting in sliding during driving operation and in failure of the continuous driving operation. Furthermore, large-torque operation could not be performed in addition to the risk of damage to the fastener.

Thus, a need exists for a super high-torque open end wrench capable of fast driving of a workpiece without the disadvantages of the above conventional open end wrenches.

BRIEF SUMMARY OF THE INVENTION

The present invention solves this need and other problems in the field of super high-torque operations of fast drivable open end wrenches by providing, in a first aspect, an open end wrench capable of fast driving a workpiece. The workpiece includes first, second, third, fourth, fifth, and sixth sides respectively having first, second, third, fourth, fifth, and sixth force-receiving faces in a first rotating direction and respectively having first, second, third, fourth, fifth, and sixth force-receiving faces in a second rotating direction. The open end wrench includes a body having a handle and a jaw portion formed on an end of the handle. Spaced first and second jaws are formed on an end of the jaw portion opposite to the handle. The jaw portion includes a throat intermediate the first and second jaws. The throat and the first and second jaws together define a wrenching space adapted for receiving the workpiece. The first jaw includes a force-applying face facing the wrenching space and facing a distal end of the second jaw. The jaw portion further includes an arcuate sliding groove formed in the second jaw and facing the wrenching space. A guide is fixed in the sliding groove. A slide is slideably received in the sliding groove. The slide includes opposite first and second ends. The first end of the slide includes a first wrenching face located outside of the sliding groove. The slide further includes an arcuate guiding slot. The guide is received in the guiding slot, preventing the slide from disengaging from the sliding groove. The guiding slot includes an abutting end. The abutting end is in contact with the guide when the slide is a free position. An elastic device is mounted between the body and the slide for returning the slide to the free position.

When the jaw portion is not engaged with the workpiece, the slide is in the free position. The first wrenching face of the slide is located in the wrenching space. The first wrenching face is not parallel to the force-applying face of the first jaw. An extension line of the first wrenching face intersects an extension line of the force-applying face of the first jaw at a point away from the handle.

When the jaw portion receives the workpiece but does not drive the workpiece, the force-applying face of the first jaw abuts the first force-receiving face in the first rotating direction of the workpiece. The first end of the slide abuts the fourth force-receiving face in the first rotating direction of the workpiece. A buffering space is formed between the abutting end of the guiding slot and the guide. The buffering space has an arc length larger than a tolerance of the workpiece.

When the jaw portion drives the workpiece and deforms elastically, the body rotates relative to the workpiece. The slide does not rotate together with the body due to the buffering space. The buffering space allows the first end of the slide to abut the fourth force-receiving face in the first rotating direction of the workpiece when the jaw portion expands elastically.

According to a second aspect, an open end wrench is provided and capable of fast driving a workpiece. The workpiece includes first, second, third, fourth, fifth, and sixth sides respectively having first, second, third, fourth, fifth, and sixth force-receiving faces in a first rotating direction and respectively having first, second, third, fourth, fifth, and sixth force-receiving faces in a second rotating direction. The open end wrench includes a body having a handle and a jaw portion formed on an end of the handle. Spaced first and second jaws are formed on an end of the jaw portion opposite to the handle. The jaw portion includes a throat intermediate the first and second jaws. The throat and the first and second jaws together define a wrenching space adapted for receiving the workpiece. The first jaw includes a force-applying face facing the wrenching space and facing a distal end of the second jaw. The jaw portion further includes an arcuate sliding groove formed in the second jaw and facing the wrenching space. A guide is fixed in the sliding groove. A slide is slideably received in the sliding groove. The slide includes opposite first and second ends. The first end of the slide includes a first wrenching face located outside of the sliding groove. The slide further includes an arcuate guiding slot. The guide is received in the guiding slot, preventing the slide from disengaging from the sliding groove. The guiding slot includes an abutting end. The abutting end is in contact with the guide when the slide is a free position. An elastic device is mounted between the body and the slide for returning the slide to the free position.

When the jaw portion is not engaged with the workpiece, the slide is in the free position. The first wrenching face of the slide is located in the wrenching space. The first wrenching face is not parallel to the force-applying face of the first jaw. An extension line of the first wrenching face intersects an extension line of the force-applying face of the first jaw at a point away from the handle.

When the jaw portion receives the workpiece but does not drive the workpiece, the force-applying face of the first jaw abuts the first force-receiving face in the first rotating direction of the workpiece. The first end of the slide abuts the fourth force-receiving face in the first rotating direction of the workpiece. A buffering angle is formed between the first wrenching face and the fourth force-receiving face in the first rotating direction of the workpiece.

When the jaw portion drives the workpiece to rotate and deforms elastically, the body rotates relative to the workpiece. The buffering angle allows the body and the slide to gradually rotate relative to the workpiece such that the first wrenching face of the slide abuts the fourth force-receiving face in the first rotating direction of the workpiece, providing surface contact between the first wrenching face of the slide and the fourth force-receiving face in the first rotating direction of the workpiece.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
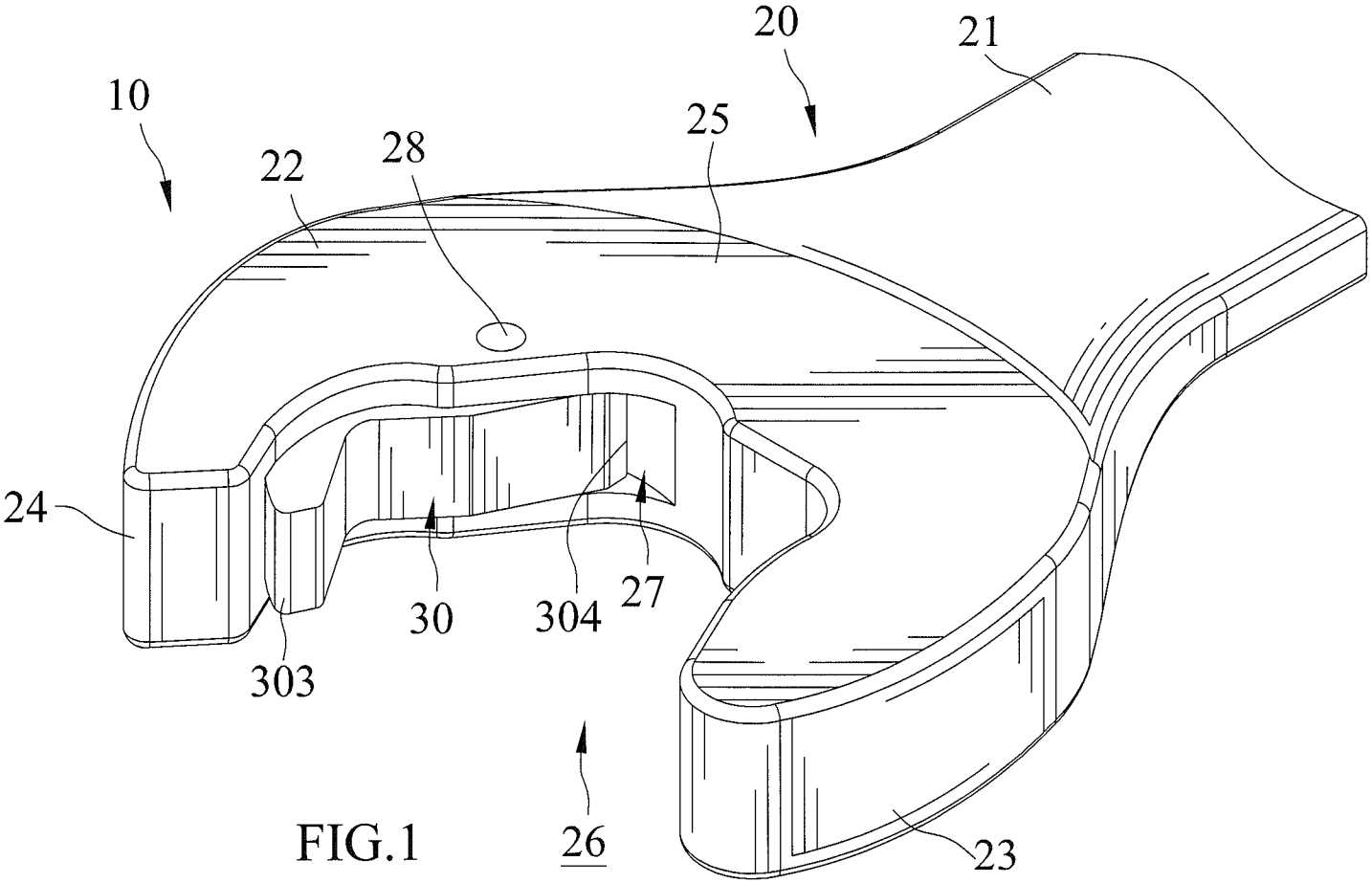
FIG. 1 shows a partial, perspective view of an open end wrench of a first embodiment according to the preferred teachings of the present invention.
Figure 2:
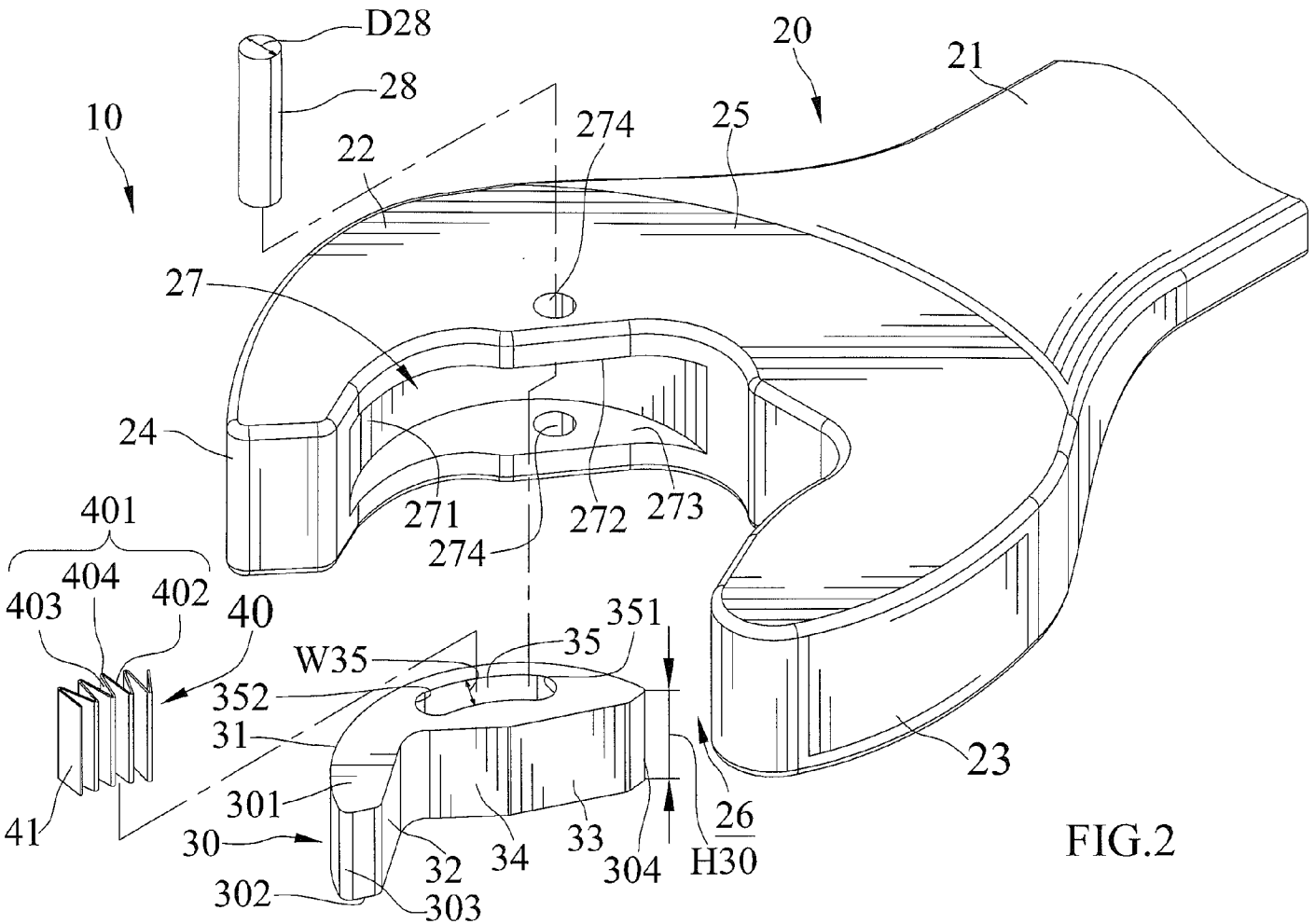
FIG. 2 shows a partial, exploded, perspective view of the open end wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "sixth", "lower", "upper", "inner", "outer", "side", "end", "portion", "section", "spacing", "clockwise", "counterclockwise", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIGS. 1-7 show an open end wrench 10 of a first embodiment according to the preferred teachings of the present invention. Open end wrench 10 includes a body 20, a slide 30, and an elastic device 40.

Body 20 includes a handle 21 and a jaw portion 22 formed on an end of handle 21. Jaw portion 22 can hold a workpiece 90, such as a hexagonal head of a bolt, a nut, or the like. Workpiece 90 includes first, second, third, fourth, fifth, and sixth sides respectively having first, second, third, fourth, fifth, and sixth force-receiving faces in a first rotating direction 91A, 92A, 93A, 94A, 95A, and 96A. The first, second, third, fourth, fifth, and sixth sides of workpiece 90 respectively have first, second, third, fourth, fifth, and sixth force-receiving faces in a second rotating direction 91B, 92B, 93B, 94B, 95B, and 96B. A user can grip the handle 21 and rotate body 20 as well as jaw portion 22 about an axis of workpiece 90 to tighten or loosen workpiece 90.

Spaced first and second jaws 23 and 24 are formed on an end of jaw portion 22 opposite to handle 21. First and second jaws 23 and 24 can withstand reactive force from workpiece 90. First and second jaws 23 and 24 face each other. Furthermore, first and second jaws 23 and 24 and jaw portion 22 are integrally formed as a single and inseparable component of the same material to provide jaw portion 22 with excellent structural strength and to increase the torque bearing capacity of jaw portion 22.

Jaw portion 22 further includes a throat 25 intermediate first and second jaws 23 and 24. Throat 25 and first and second jaws 23 and 24 together define a wrenching space 26. Jaw portion 22 can enter wrenching space 26 by moving jaw portion 22 in a direction perpendicular to one of the six sides of workpiece 90 or by moving jaw portion 22 along the axis of workpiece 90.

First jaw 23 includes a force-applying face 231 facing wrenching space 26 and facing a distal end of second jaw 24. Force-applying face 231 corresponds to first force-receiving face in the first rotating direction 91A of workpiece 90. Second jaw 24 includes first and second faces 241 and 242. First face 241 faces wrenching space 26 and throat 25. Second face 242 faces wrenching space 26 and a distal end of first jaw 23. First face 241 is at an angle of 120° to second face 242 such that first and second faces 241 and 242 correspond respectively to fourth and third force-receiving faces in the first rotating direction 94A and 93A. In this embodiment, first face 241 of second jaw 24 is substantially parallel to force-applying face 231 of first jaw 23. Namely, an extension line L241 of first face 241 is parallel to an extension line L231 of force-applying force 231. Thus, jaw portion 22 has an opening spacing $\alpha 0$ between first face 241 and force-applying face 231.

Throat 25 includes a push face 251 facing wrenching space 26. Push face 251 is at an angle of 120° to force-applying face 231 of first jaw 23 such that push face 251 corresponds to second force-receiving face in the first rotating direction 92A. Second face 242 is intermediate first face 241 and push face 251.

Jaw portion 22 further includes a first evasive portion 221 between force-applying face 231 of first jaw 23 and push face 251 of throat 25. First evasive portion 221 can receive first force-receiving face in the second rotating direction 91B of workpiece 90. Jaw portion 22 further includes a second evasive portion 222 between push face 251 of throat 25 and second face 242 of second jaw 24. Second evasive portion 222 can receive second force-receiving face in the second rotating direction 92B of workpiece 90. Furthermore, jaw portion 22 includes a third evasive portion 223 between first and second faces 241 and 242 of the second jaw 24. Third evasive portion 223 can receive third force-receiving face in the second rotating direction 93B of workpiece 90.

An arcuate sliding groove 27 is formed in second jaw 24 and faces wrenching space 26. Sliding groove 27 includes spaced, first and second support walls 272 and 273 and a concave, arcuate sliding wall 271 extending between first and second support walls 272 and 273. Sliding wall 271 is free of holes, grooves, recesses, etc., providing a complete concave, arcuate surface and enhancing the structural strength of second jaw 24. Thus, jaw portion 22 can withstand high-torque operation. Furthermore, a center of an arcuate face of the sliding wall 271 is located in wrenching space 26 such that sliding wall 271 can be easily and rapidly processed with a single cutter at low costs while assuring structural strength of jaw portion 22. First and second support walls 272 and 273 are parallel to each other and have a spacing therebetween.

A circular through-hole 274 is extended through first and second support walls 272 and 273 and in communication with sliding groove 27. Through-hole 274 is located adjacent to throat 25 and receives a cylindrical guide 28 in the form of a pin. Two ends of guide 28 are received in two ends of through-hole 274 in first and second support walls 272 and 273 to retain guide 28 in sliding groove 27. Guide 28 has a diameter D28.

Slide 30 is slideably received in sliding groove 27 and can drive workpiece 90 to rotate in a driving direction or slide along a perimeter of workpiece 90 in an opposite direction opposite to the driving direction without driving workpiece 90. Slide 30 is substantially arcuate in cross section and includes a side having a convex, arcuate sliding face 31 slideably abutting sliding wall 271 of sliding groove 27, allowing relative arcuate sliding movement between slide 30 and jaw portion 22. Sliding face 31 is free of holes, grooves, recesses, etc., providing a complete arcuate surface and enhancing the structural strength of slide 30. Thus, slide 30 can withstand high-torque operation.

Sliding face 31 of slide 30 has a curvature the same as that of sliding wall 271 of sliding groove 27 to allow smooth sliding of sliding face 31 on sliding wall 271. Furthermore, when slide 30 is subjected to reactive force from workpiece 90, the reactive force from the workpiece 90 can be transmitted to sliding wall 271 through a large area of sliding face 31 due to the same curvature. Thus, the force imparted to slide 30 can be distributed, avoiding stress concentration and increasing the torque bearing capacity of slide 30 when workpiece 90 is driven by body 20.

Slide 30 includes opposite first and second ends 303 and 304 for driving workpiece 90. First end 303 of slide 30 includes a first wrenching face 32 located outside of sliding groove 27. Second end 304 includes a second wrenching face 33 located outside of sliding groove 27. First and second wrenching faces 32 and 33 are located on the other side of slide 30 opposite to sliding face 31. First wrenching face 32 is at an angle of 120° to second wrenching face 33 for the purpose of driving workpiece 90. An evasive portion 34 is formed between first and second wrenching faces 32 and 33 and can receive third force-receiving face in the second rotating direction 93B of workpiece 90.

Slide 30 further includes a top face 301 and a bottom face 302 respectively at upper and lower sides thereof. First and second wrenching faces 32 and 33 extend between top and bottom faces 301 and 302. Top and bottom faces 301 and 302 are parallel to each other and respectively in contact with first and second support walls 272 and 273 of sliding groove 27. Slide 30 has a height H30 between top and bottom faces 301 and 302 in a height direction. Ignoring the tolerance, height H30 of slide 30 is the same as the spacing between first and second support walls 272 and 273 of sliding groove 27. This allows top and bottom faces 301 and 302 of slide 30 to be symmetrically supported by first and second support walls 272 and 273 of sliding groove 27, avoiding wobbling of slide 30 while sliding in sliding groove 27 along an arcuate path and increasing operational stability of open end wrench 10.

Slide 30 further includes a guiding slot 35 extending from top face 301 through bottom face 302. Guiding slot 35 is arcuate in cross section and has a curvature the same as the curvature of sliding wall 271 of sliding groove 27. Since guiding slot 35 extends from top face 301 through bottom face 302, a height of guiding slot 35 in the height direction of slide 30 is the same as height H30 of slide 30. Furthermore, guiding slot 35 has a width W35 (between inner and outer arcuate surfaces thereof) in a width direction perpendicular to the height direction of slide 30. Namely, width W35 is equal to a difference between a radius of the outer arcuate surface and a radius of the inner arcuate surface of guiding slot 35. Ignoring the tolerance, width W35 of guiding slot 35 is the same as diameter D28 of guide 28. The height of guiding slot 35 is larger than 1.5 times width W35 of guiding slot 35 (i.e., width W35 of guiding slot 35 is smaller than 0.66 times the height of guiding slot 35). In this embodiment, the height of guiding slot 35 is larger than two times width W35 of guiding slot 35 (i.e., width W35 of guiding slot 35 is smaller than 0.5 times the height of guiding slot 35).

Guiding slot 35 receives guide 28 to prevent slide 30 from disengaging from sliding groove 27. Since the curvature of sliding face 31 of slide 30 is the same as those of guiding slot 35 and sliding wall 271 of sliding groove 27, smooth sliding movement between guiding slot 35 of slide 30 and guide 28 in sliding groove 27 can be obtained while sliding face 31 of slide 30 is moving along sliding wall 271 of sliding groove 27 along the arcuate path. Undesired interference between slide 30, guide 28, and sliding wall 271 is avoided.

Guiding slot 35 further includes an abutting end 351 and a pressing end 352. When slide 30 is in a free position, abutting end 351 is in contact with guide 28, and pressing end 352 is in contact with elastic device 40. Since all of the surfaces of guiding slot 35 are free of holes, grooves, recesses, etc., stress concentration is avoided, and the structural strength of slide 30 is assured. Thus, slide 30 can withstand high-torque operation. Furthermore, since sliding face 31 and all of the surfaces of guiding slot 35 of slide 30 are free of holes, grooves, recesses, etc., the manufacturing costs of slide 30 can be reduced while providing open end wrench 10 with high-torque capacity and allowing open end wrench 10 to be produced at low costs for wider industrial application.

Elastic device 40 is mounted between body 20 and slide 30. Elastic device 40 has two ends respectively abutting guide 28 and pressing end 352 of guiding slot 35 for returning slide 30 to the free position. Elastic device 40 includes an elastic element 41 mounted in guiding slot 35 of slide 30. After mounting, elastic element 41 is completely received in guiding slot 35. Elastic element 41 has a height in the height direction of slide 30 not larger than the height of guiding slot 35 but larger than width W35 of guiding slot 35. Furthermore, the height of elastic element 41 is larger than 0.5 times the height of guiding slot 35. Thus, rotation of elastic element 41 in guiding slot 35 is avoided, preventing slide 30 from shifting from the free position after returning.

In this embodiment, elastic element 41 is a resilient plate having Z-shaped cross sections. At least one force-storing unit 401 is provided between two ends of elastic element 41. Each force-storing unit 401 is in the form of a metal plate having substantially V-shaped cross sections. Each force-storing unit 401 includes first and second legs 402 and 403 and a compression section 404 between first and second legs 402 and 403. Compression section 404 can store energy when first and second legs 402 and 403 are compressed, providing force-storing unit 401 with an elastic returning function. First leg 402 of each force-storing unit 401 is connected to second leg 403 of an adjacent force-storing unit 401. Thus, compression section 404 of each force-storing unit 401 possesses an elastic returning function. First leg 402 on an end of elastic element 41 abuts guide 28, and second leg 403 on the other end of elastic element 41 abuts pressing end 352 of guiding slot 35. Thus, slide 30 can be automatically returned to the free position.

Figure 3:
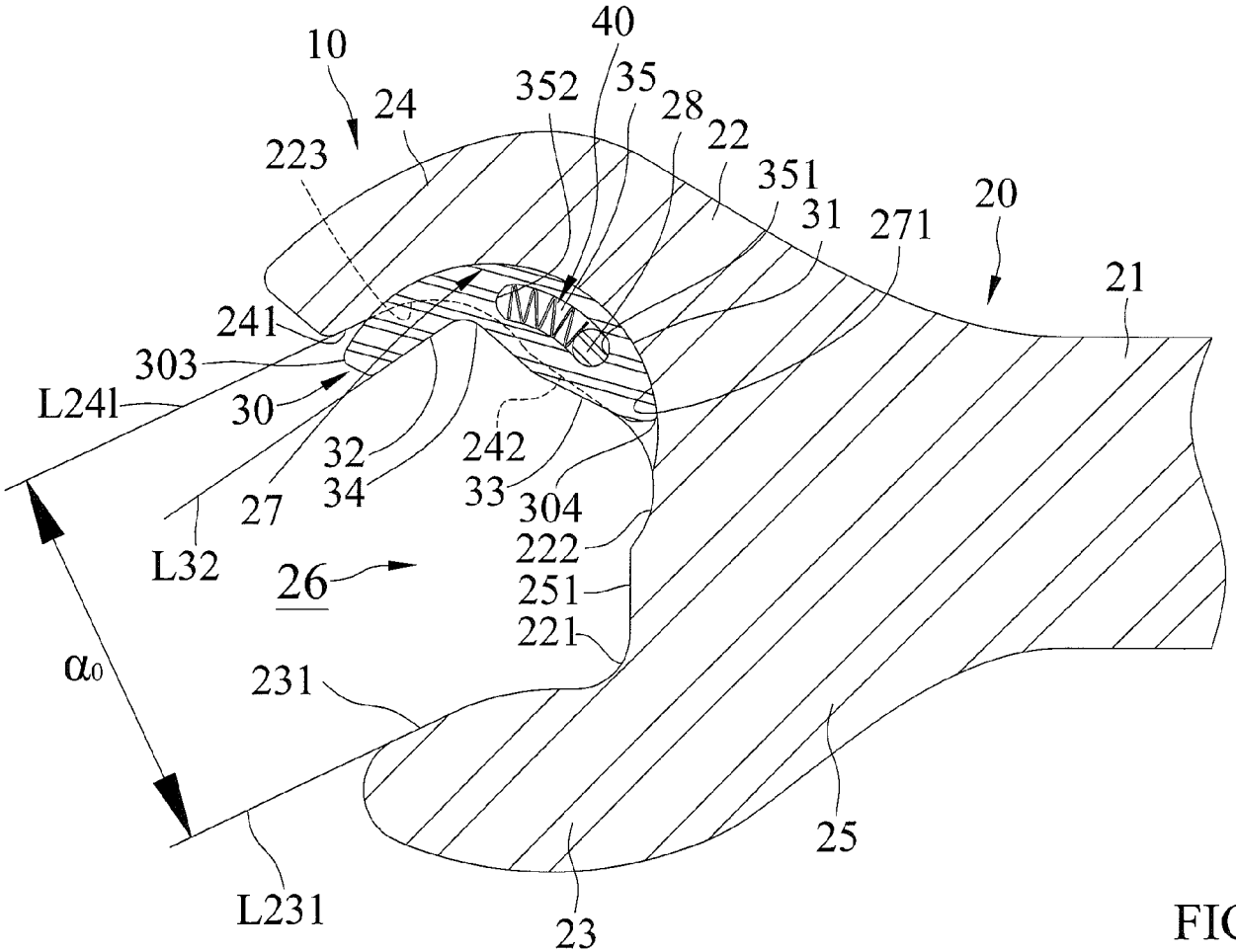
FIG. 3 shows a partial, cross sectional view of the open end wrench of FIG. 1.

Slide 30 is in the free position before jaw portion 22 is engaged with workpiece 90 (see FIG. 3). First wrenching face 32 of slide 30 is located in wrenching space 26. First wrenching face 32 of slide 30 is not parallel to force-applying face 231 of first jaw 23. Abutting end 351 of guiding slot 35 is in contact with guide 28.

As can be seen in FIG. 3, an extension line L32 of first wrenching face 32 is not parallel to extension line L231 of force-applying face 231. Thus, extension line L32 of first wrenching face 32 intersects extension line L231 of force-applying face 231 at a point away from handle 21 of body 20.

When jaw portion 22 is engaged with workpiece 90 but does not drive workpiece 90 (see FIG. 4), force-applying face 231 of first jaw 23 abuts first force-receiving face in the first rotating direction 91A of workpiece 90, and first end 303 of slide 30 abuts fourth force-receiving face in the first rotating direction 94A of workpiece 90 such that first wrenching face 32 of slide 30 is parallel to force-applying face 231 of first jaw 23.

Figure 4:
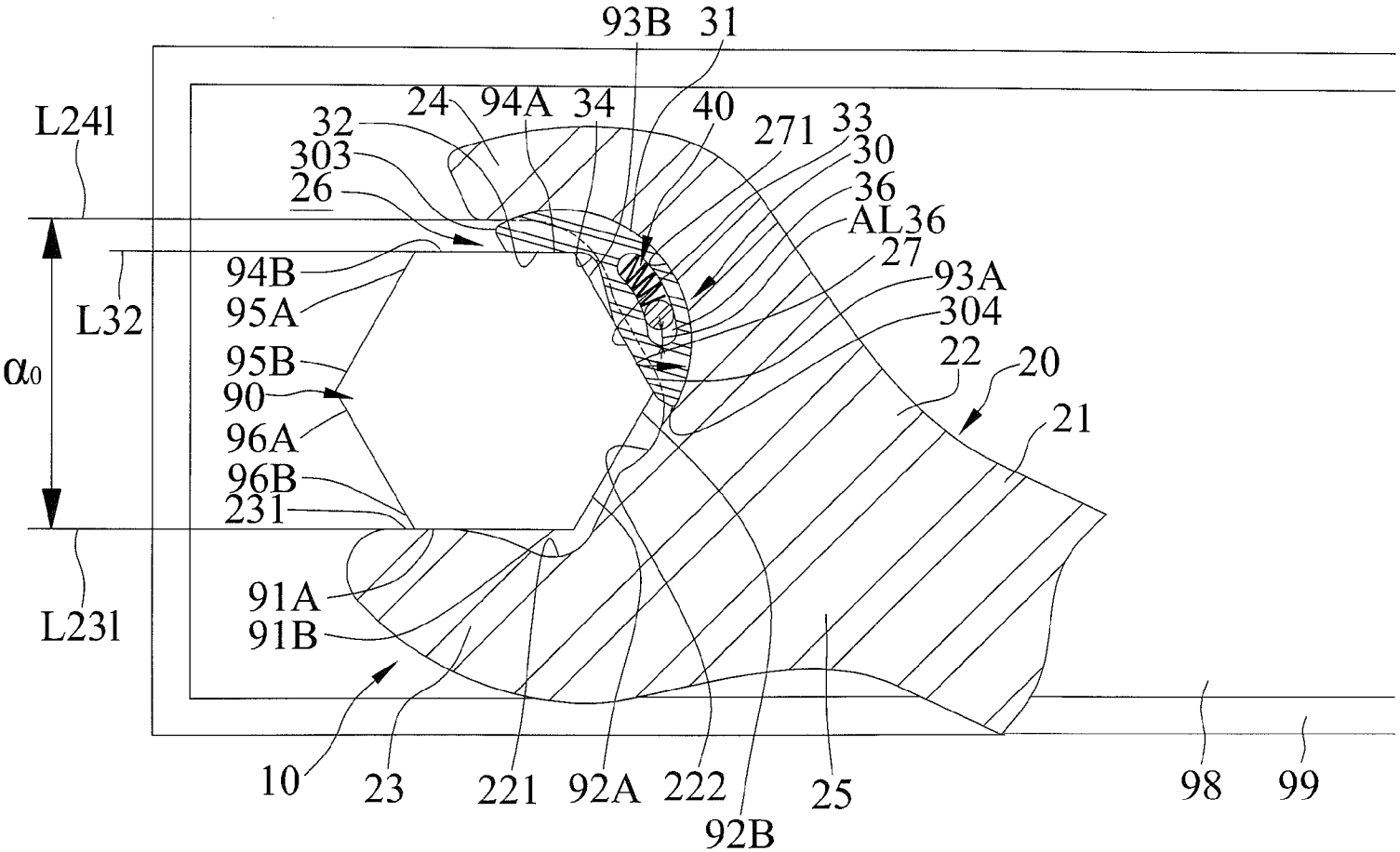
FIG. 4 shows a perspective view illustrating use of the open end wrench of FIG. 1 on a workpiece.

As can be seen in FIG. 4, extension line L32 of first wrenching face 32 is parallel to extension line L231 of force-applying face 231. Thus, force-applying face 231 and first wrenching face 32 can respectively abut first and fourth force-receiving faces in the first rotating direction 91A and 94A of workpiece 90.

At the same time, a buffering space 36 is formed between abutting end 351 of guiding slot 35 and guide 28. Buffering space 36 assures abutting of first end 303 of slide 30 against fourth force-receiving face in the first rotating direction 94A of workpiece 90 when jaw portion 22 expands elastically. Since first wrenching face 32 of slide 30 is at an angle of 120° to second wrenching face 33 and since buffering space 36 is formed between abutting end 351 of guiding slot 35 and guide 28, first wrenching face 32 of slide 30 still abuts fourth force-receiving face in the first rotating direction 94A of workpiece 90 when jaw portion 22 expands elastically.

Buffering space 36 has an arc length AL36 larger than the tolerance of workpiece 90. Namely, ignoring the tolerance difference of the same specification of workpiece 90, arc length AL36 must be larger than the tolerance of workpiece 90. By such an arrangement, buffering space 36 maintains abutting of slide 30 against fourth force-receiving face in the first rotating direction 94A of workpiece 90 when jaw portion 22 expands elastically.

More preferably, arc length AL36 is larger than half of width W35 of guiding slot 35. Namely, arc length AL36 is larger than half of diameter D28 of guide 28.

FIG. 4 shows engagement of jaw portion 22 of open end wrench 10 according to the preferred teachings of the present invention with workpiece 90 in the form of a bolt extended through a first board 98 and then screwed through a second board 99. Before driving workpiece 90, workpiece 90 is entered wrenching space 26 of jaw portion 22 with force-applying face 231 of first jaw 23 abutting first force-receiving face in the first rotating direction 91A of workpiece 90 and with first end 303 of slide 30 abutting fourth force-receiving face in the first rotating direction 94A of workpiece 90.

At the same time, buffering space 36 is formed between abutting end 351 of guiding slot 35 and guide 28 and is larger than the tolerance of workpiece 90 of its specification.

When workpiece 90 enters wrenching space 26, first end 303 of slide 30 is pushed by workpiece 90 and compresses elastic device 40. Slide 30 slides along an arcuate path relative to body 20 until workpiece 90 comes in contact with second wrenching face 33 of slide 30. In this case, slide 30 is pushed by elastic device 40 such that first wrenching face 32 of slide 30 is in intimate contact with fourth force-receiving face in the first rotating direction 94A of workpiece 90, providing surface contact therebetween. Since fourth force-receiving face in the first rotating direction 94A of workpiece 90 is parallel to first force-receiving face in the first rotating direction 91A of workpiece 90, first wrenching face 32 of slide 30 is substantially parallel to force-applying face 231 of first jaw 23.

Figure 5:
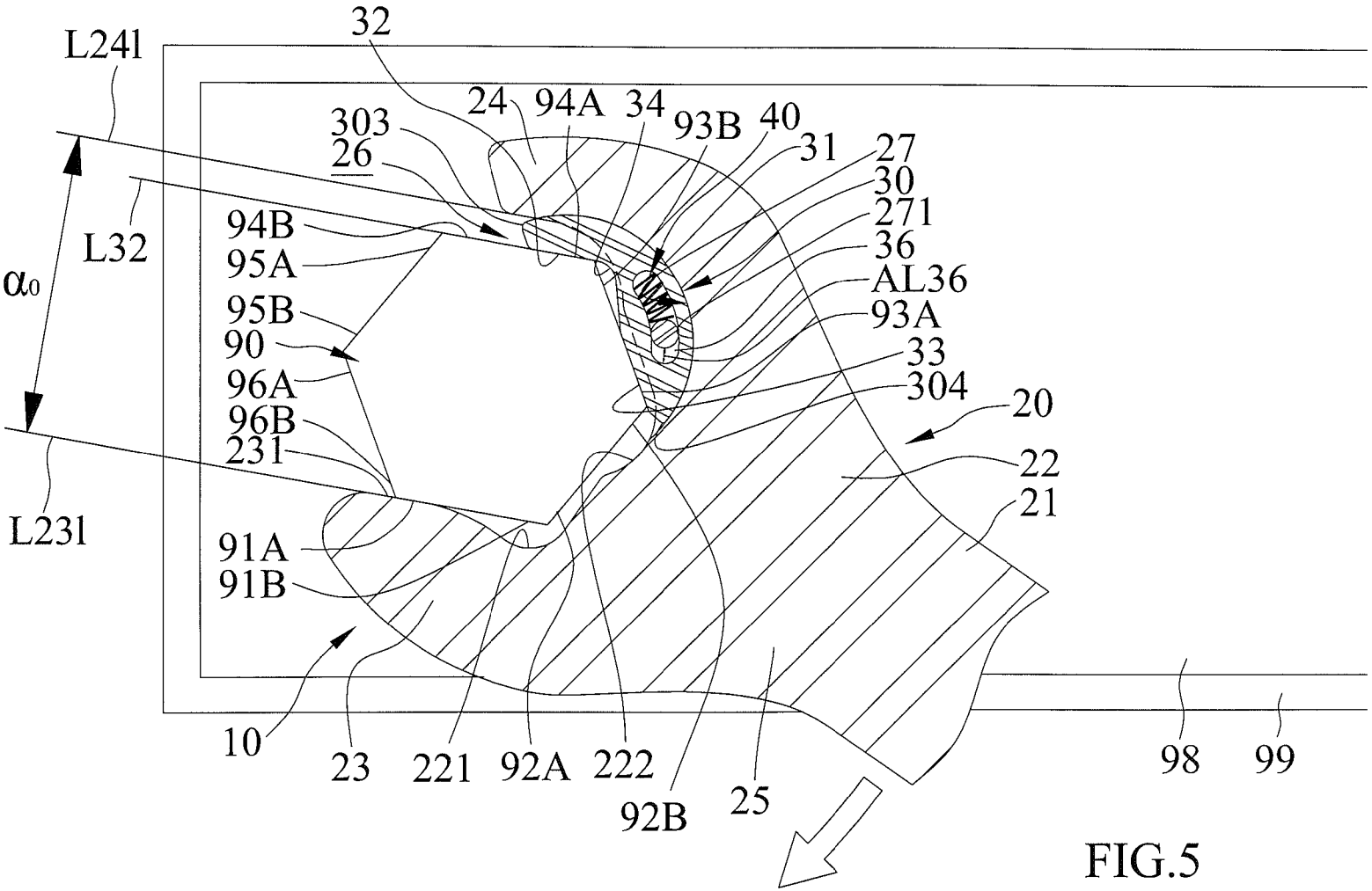
FIG. 5 shows a partial, cross sectional view illustrating rotation of the open end wrench of FIG. 4 in a driving direction to drive the workpiece in the same direction.

FIG. 5 shows driving of workpiece 90 by jaw portion 22 of open end wrench 10 according to the preferred teachings of the present invention towards first jaw 23 (in the clockwise direction in FIG. 5). Workpiece 90 is driven by jaw portion 22 to rotate about the axis of workpiece 90. The force applied by the user is transmitted to first force-receiving face in the first rotating direction 91A of workpiece 90 via force-applying face 231 of first jaw 23 and transmitted to fourth force-receiving face in the first rotating direction 94A of workpiece 90 via first wrenching face 32 of slide 30. Thus, workpiece 90 rotates together with jaw portion 22. Second wrenching face 33 of slide 30 abuts third force-receiving face in the first rotating direction 93A of workpiece 90 to assist in driving of workpiece 90.

Since first jaw 23 and jaw portion 22 are integrally formed as a single and inseparable component of the same material, force-applying face 231 of first jaw 23 can effectively withstand the reactive force from first force-receiving face in the first rotating direction 91A of workpiece 90. Furthermore, since second jaw 24 and jaw portion 22 are integrally formed as a single and inseparable component of the same material and since sliding face 31 of slide 30 and sliding wall 271 of sliding groove 27 are free of holes, grooves, recesses, etc., and have the same curvature and are in surface contact with each other, first wrenching face 32 of slide 30 can effectively withstand the reactive force from fourth force-receiving face in the first rotating direction 94A of workpiece 90. Thus, open end wrench 10 according to the preferred teachings of the present invention can withstand high-torque operation.

In this embodiment, second wrenching face 33 of slide 30 abuts third force-receiving face in the first rotating direction 93A of workpiece 90. Since second jaw 24 and jaw portion 22 are integrally formed as a single and inseparable component of the same material and since sliding face 31 of slide 30 and sliding wall 271 of sliding groove 27 are free of holes, grooves, recesses, etc., and have the same curvature and are in surface contact with each other, second wrenching face 33 of slide 30 can effectively withstand the reactive force from third force-receiving face in the first rotating direction 93A of workpiece 90. Thus, open end wrench 10 according to the preferred teachings of the present invention can withstand high-torque operation.

In this embodiment, second wrenching face 33 of slide 30 abuts third force-receiving face in th first rotating direction 93A of workpiece 90. since second jaw 24 and jaw portion 22 are integrally formed as a single and inseperable component of the same material and since sliding face 31 of slide 30 and sliding wall 271 of sliding groove 27 are free of holes, grooves, recesses, etc and have the same curvature and are in surface contact with each other, second wrenching face 33 or slide 30 can effectively withstand the reactive force from third force-receiving face in the first rotating direction 93A of workpiece 90. Thus, open end wrench 10 according to the preferred teachings of the present invention can withstand high-torque operation.

Since the user applies the force through handle 21, if the arm of force and the force remain the same, workpiece 90 can be driven by the torque in the clockwise direction until a torque in the counterclockwise direction acting on workpiece 90 is equal to the clockwise torque. In this case, workpiece 90 is stopped after having been rotated through 10° relative to first and second boards 98 and 99, as shown in FIG. 5.

Figure 6:
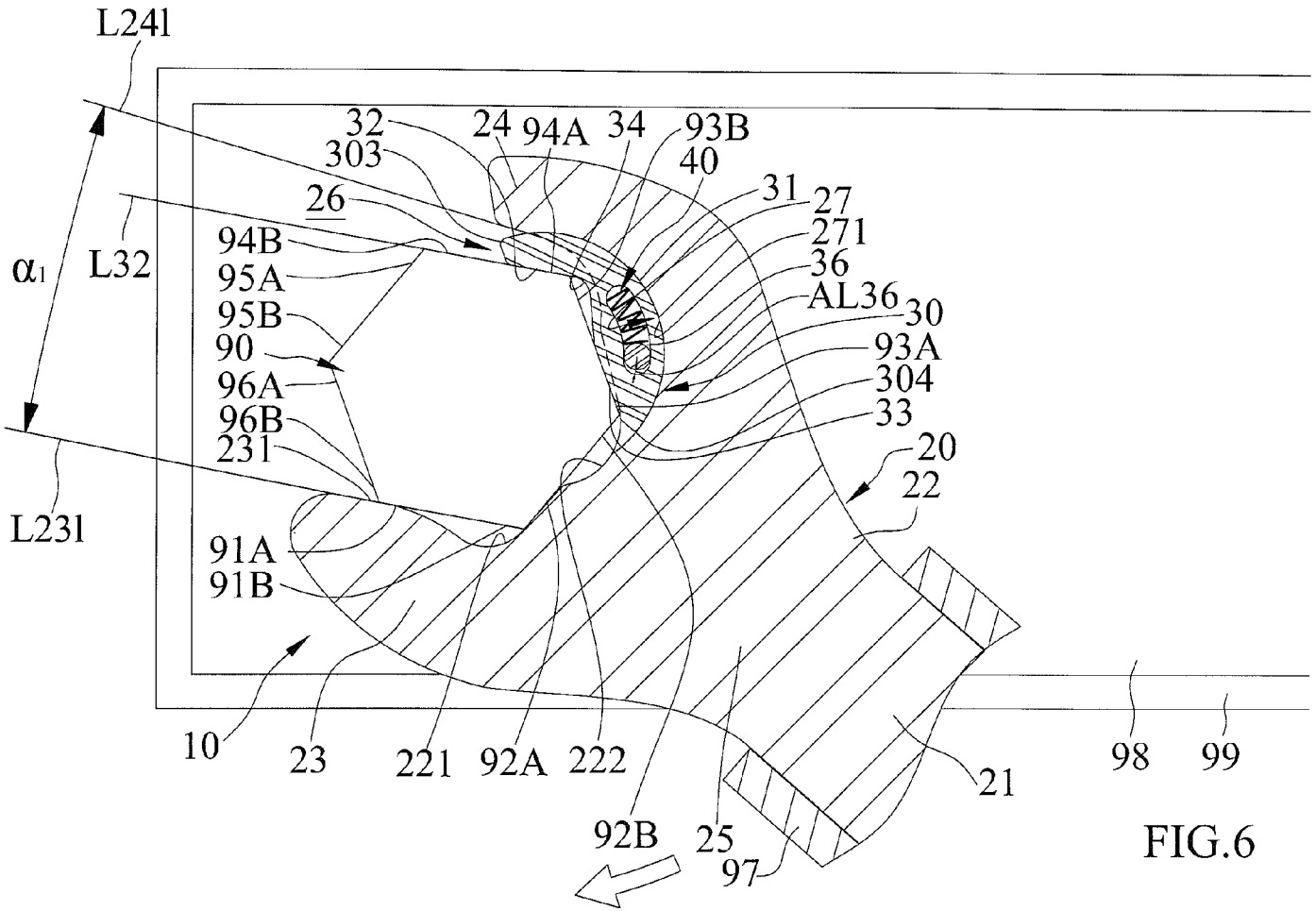
FIG. 6 shows a partial, cross sectional view illustrating further rotation of the open end wrench of FIG. 5 in the driving direction through use of an extension tube.
Figure 7:
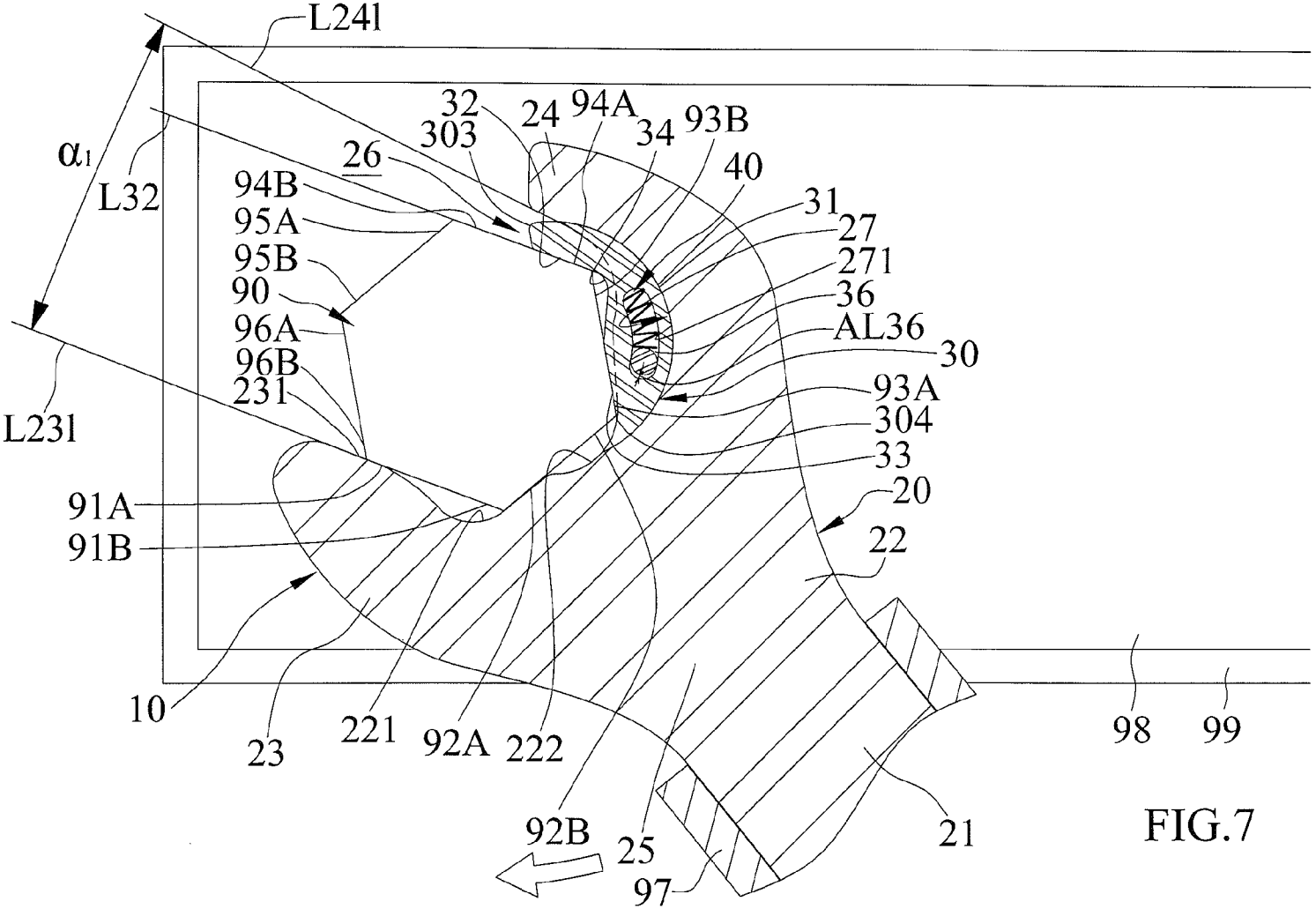
FIG. 7 shows a partial, cross sectional view illustrating further rotation of the open end wrench of FIG. 6 in the driving direction.

With reference to FIGS. 6 and 7, to further tighten workpiece 90, an extension tube 97 is engaged with handle 21 to provide an increased arm of force equal to or more than twice the original arm of force, providing double (or higher) toque with the same force.

When workpiece 90 is tightened to a certain extent by using extension tube 97, the reactive force imparted from workpiece 90 to jaw portion 22 increases and causes elastic deformation of jaw portion 22. Workpiece 90 no longer rotates together with open end wrench 10, and body 20 gradually rotates clockwise relative to workpiece 90. In this case, the slide 30 does not rotate together with the body 20 in the clockwise direction due to existence of buffering space 36. Thus, first wrenching face 32 of slide 30 remains in surface contact with fourth force-receiving face in the first rotating direction 94A of workpiece 90 while arc length AL36 of buffering space 36 is reduced.

Opening space of jaw portion 22 increases (see opening spacing $\alpha 1$ in FIG. 6) such that the stress acting on the deforming jaw portion 22 increases to resist deformation. When the stress resisting deformation of jaw portion 22 becomes larger than the reacting force from workpiece 90, jaw portion 22 no longer deforms. In this case, slide 30 can be driven again by jaw portion 22 to proceed with supper high-torque operation of open end wrench 10.

Then, the user rotates jaw portion 22 in the driving direction by using extension tube 97 to drive workpiece 90 to rotate about the axis of workpiece 90. The force applied by the user is transmitted to first force-receiving face in the first rotating direction 91A of workpiece 90 via force-applying face 231 of first jaw 23 and transmitted to fourth force-receiving face in the first rotating direction 94A of workpiece 90 via first wrenching face 32 of slide 30. Thus, workpiece 90 continues to rotate together with jaw portion 22, proceeding with super high-torque operation until workpiece 90 is tightened. During the operation, push face 251 of throat 25 abuts second force-receiving face in the first rotating direction 92A of workpiece 90 to assist in driving of workpiece 90.

It can be appreciated that open end wrench 10 according to the preferred teachings of the present invention can be rotated in an opposite, non-driving direction without driving workpiece 90. Namely, open end wrench 10 is moved in the opposite direction back to a position ready for driving workpiece 90 without the need of disengaging workpiece 90 from wrenching space 26 of jaw portion 22 and subsequent reengaging workpiece 90 in wrenching space 26, allowing fast driving of workpiece 90.

FIGS. 8-15 show an open end wrench 10 of a second embodiment according to the preferred teachings of the present invention that is substantially the same as the first embodiment except that the angle between first and second wrenching faces 32 and 33 of slide 30 is smaller than 118°.

When jaw portion 22 receives the workpiece 90 but does not drive workpiece 90, first end 303 of slide 30 abuts second force-receiving face in the first rotating direction 92A of workpiece 90 such that a buffering angle $\theta$ is formed between first wrenching face 32 of slide 30 and fourth force-receiving face in the first rotating direction 94A of workpiece 90. The buffering angle $\theta$ is larger than 2°. Namely, the angle between first and second wrenching faces 32 and 33 of slide 30 is smaller than 118°. Buffering angle $\theta$ allows body 20 and slide 30 to gradually rotate relative to workpiece 90 when jaw portion 22 expands elastically, such that first wrenching face 32 of slide 30 abuts fourth force-receiving face in the first rotating direction 94A of workpiece 90, providing surface contact between first wrenching face 32 of slide 30 and fourth force-receiving face in the first rotating direction 94A of the workpiece 90.

Figure 8:
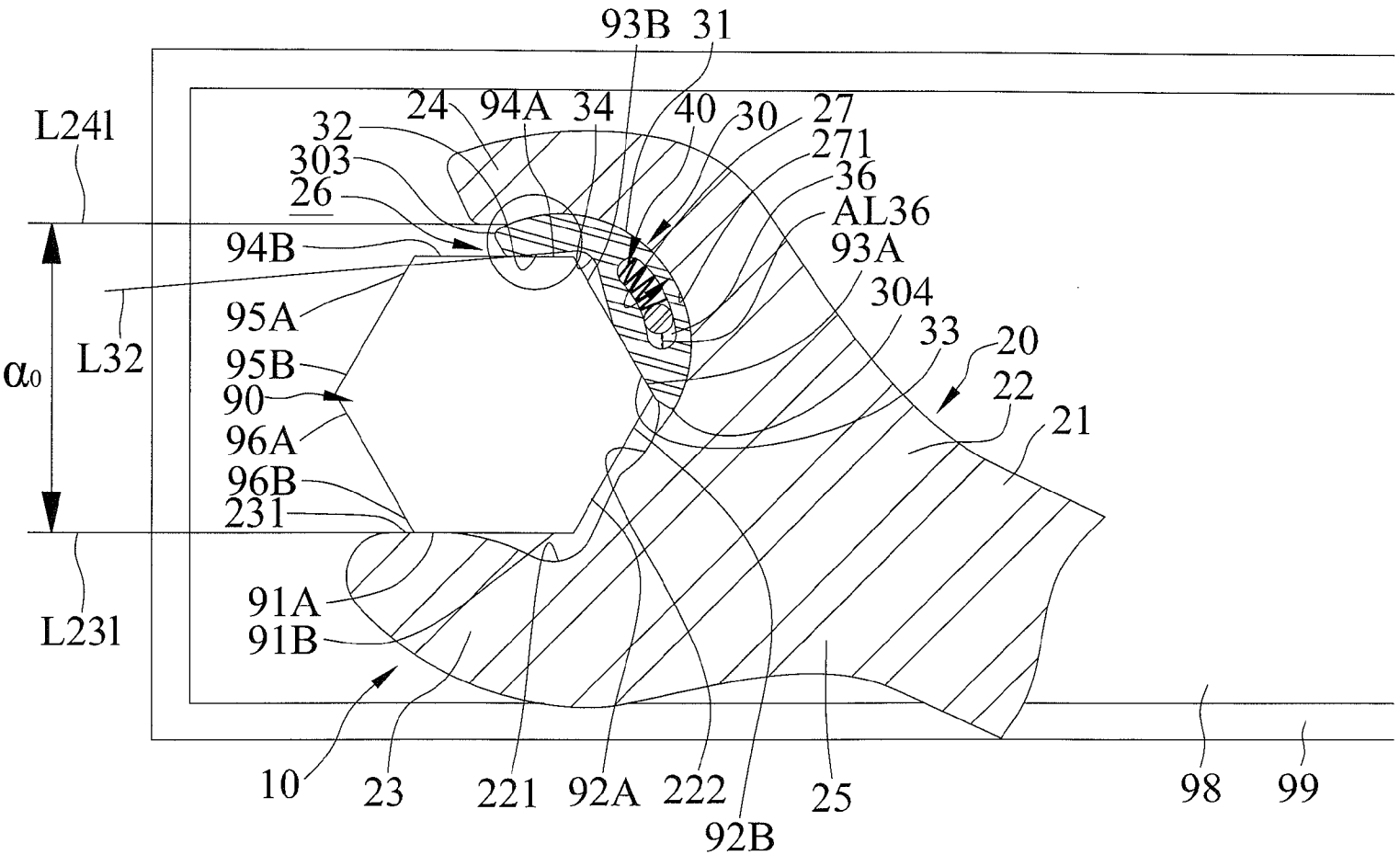
FIG. 8 shows a partial, cross sectional view of an open end wrench of a second embodiment according to the preferred teachings of the present invention.
Figure 9:
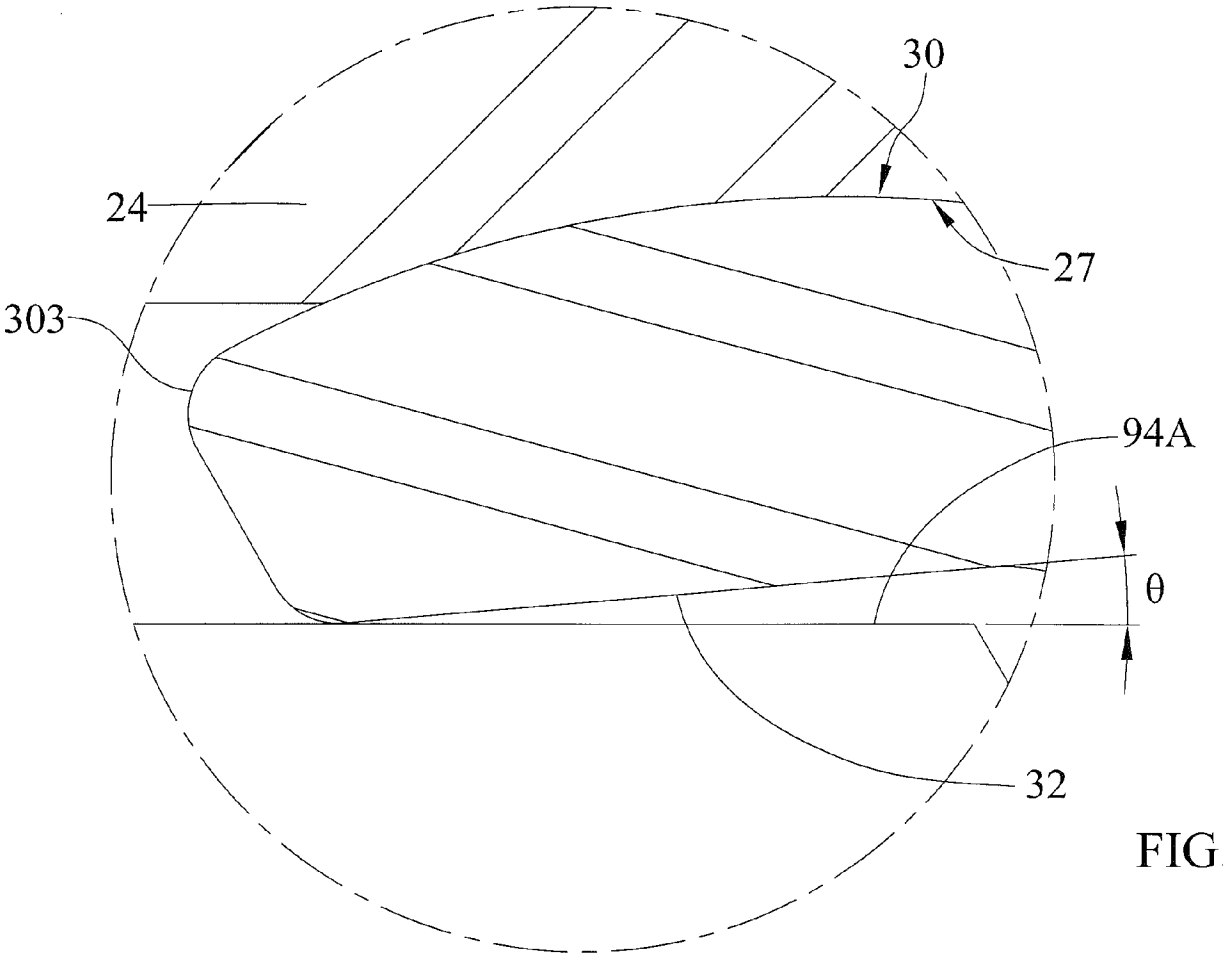
FIG. 9 shows an enlarged view of a circled portion in FIG. 8.

FIGS. 8 and 9 show engagement of jaw portion 22 of open end wrench 10 according to the preferred teachings of the present invention with workpiece 90 in the form of a bolt extended through a first board 98 and then screwed through a second board 99. Before driving workpiece 90, workpiece 90 enters wrenching space 26 of jaw portion 22 with force-applying face 231 of first jaw 23 abutting first force-receiving face in the first rotating direction 91A of workpiece 90 and with first end 303 of slide 30 abutting fourth force-receiving face in the first rotating direction 94A of workpiece 90.

At the same time, buffering space 36 is formed between abutting end 351 of guiding slot 35 and guide 28 and is larger than the tolerance of workpiece 90 of its specification.

When workpiece 90 enters wrenching space 26, first end 303 of slide 30 is pushed by workpiece 90 and compresses elastic device 40. Slide 30 slides along an arcuate path relative to body 20 until workpiece 90 comes in contact with second wrenching face 33 of slide 30. In this case, slide 30 is pushed by elastic device 40 such that first end 303 of slide 30 abuts fourth force-receiving face in the first rotating direction 94A of workpiece 90. Since fourth force-receiving face in the first rotating direction 94A of workpiece 90 is parallel to first force-receiving face in the first rotating direction 91A of workpiece 90, buffering angle θ is formed between first wrenching face 32 of slide 30 and force-applying face 231 of first jaw 23.

Figure 10:
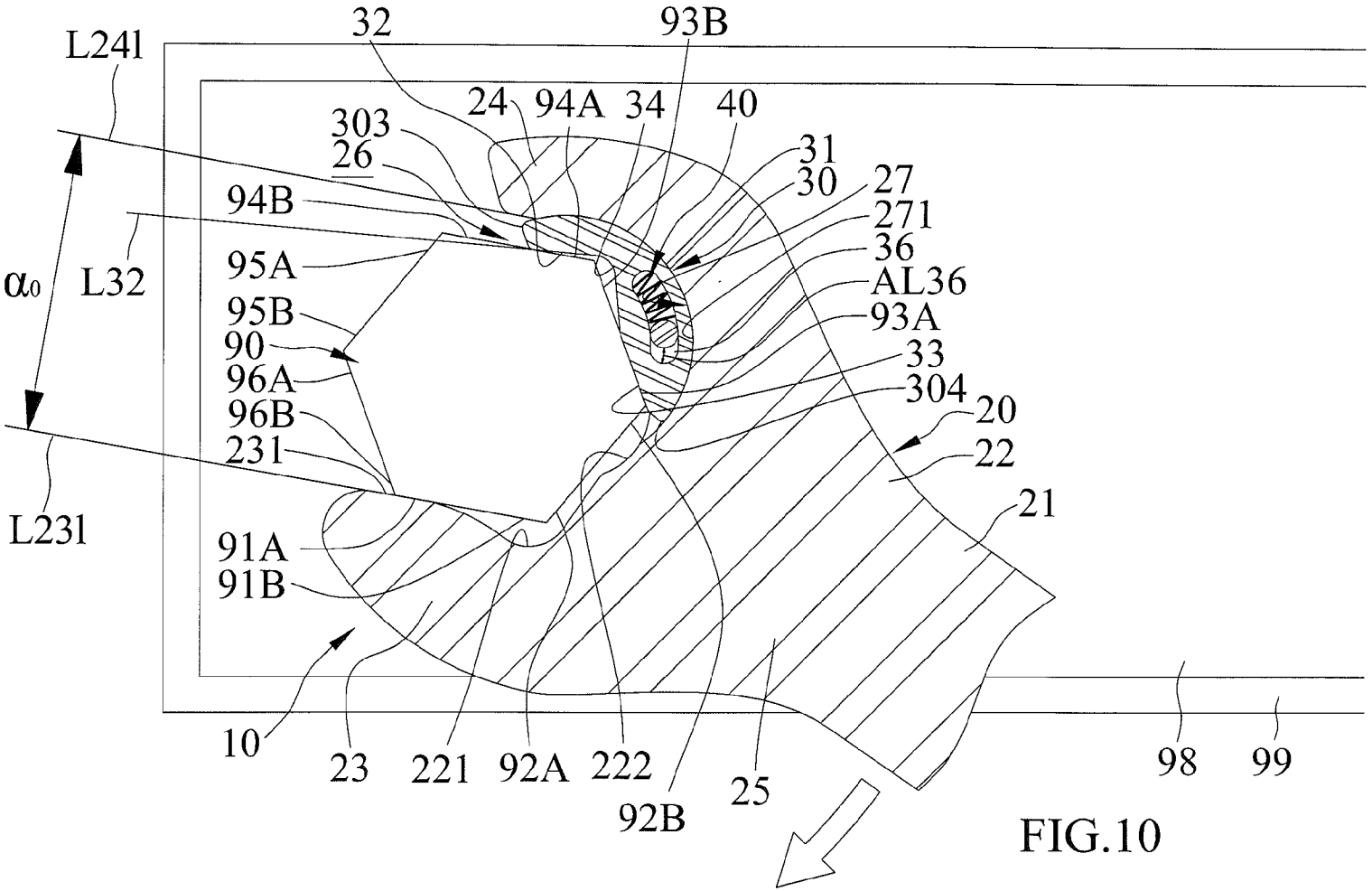
FIG. 10 shows a partial, cross sectional view illustrating use of the open end wrench of FIG. 8 on a workpiece with the open end wrench rotated in a driving direction.

FIG. 10 shows driving of workpiece 90 by jaw portion 22 of open end wrench 10 according to the preferred teachings of the present invention towards first jaw 23 (in the clockwise direction in FIG. 10). Workpiece 90 is driven by jaw portion 22 to rotate about the axis of workpiece 90. The force applied by the user is transmitted to first force-receiving face in the first rotating direction 91A of workpiece 90 via force-applying face 231 of first jaw 23 and transmitted to fourth force-receiving face in the first rotating direction 94A of workpiece 90 via first end 303 of slide 30. Thus, workpiece 90 rotates together with jaw portion 22. Second wrenching face 33 of slide 30 abuts third force-receiving face in the first rotating direction 93A of workpiece 90 to assist in driving of workpiece 90.

Since first jaw 23 and jaw portion 22 are integrally formed as a single and inseparable component of the same material, force-applying face 231 of first jaw 23 can effectively withstand the reactive force from first force-receiving face in the first rotating direction 91A of workpiece 90. Furthermore, since second jaw 24 and jaw portion 22 are integrally formed as a single and inseparable component of the same material and since sliding face 31 of slide 30 and sliding wall 271 of sliding groove 27 are free of holes, grooves, recesses, etc., and have the same curvature and are in surface contact with each other, first wrenching face 32 of slide 30 can effectively withstand the reactive force from fourth force-receiving face in the first rotating direction 94A of workpiece 90. Thus, open end wrench 10 according to the preferred teachings of the present invention can withstand high-torque operation.

In this embodiment, second wrenching face 33 of slide 30 abuts third force-receiving face in the first rotating direction 93A of workpiece 90. Since second jaw 24 and jaw portion 22 are integrally formed as a single and inseparable component of the same material and since sliding face 31 of slide 30 and sliding wall 271 of sliding groove 27 are free of holes, grooves, recesses, etc., and have the same curvature and are in surface contact with each other, second wrenching face 33 of slide 30 can effectively withstand the reactive force from third force-receiving face in the first rotating direction 93A of workpiece 90. Thus, open end wrench 10 according to the preferred teachings of the present invention can withstand high-torque operation.

Since the user applies the force through handle 21, if the arm of force and the force remain the same, workpiece 90 can be driven by the torque in the clockwise direction until a torque in the counterclockwise direction acting on workpiece 90 is equal to the clockwise torque. In this case, workpiece 90 is stopped after having been rotated through 10° relative to first and second boards 98 and 99, as shown in FIG. 10.

Figure 11:
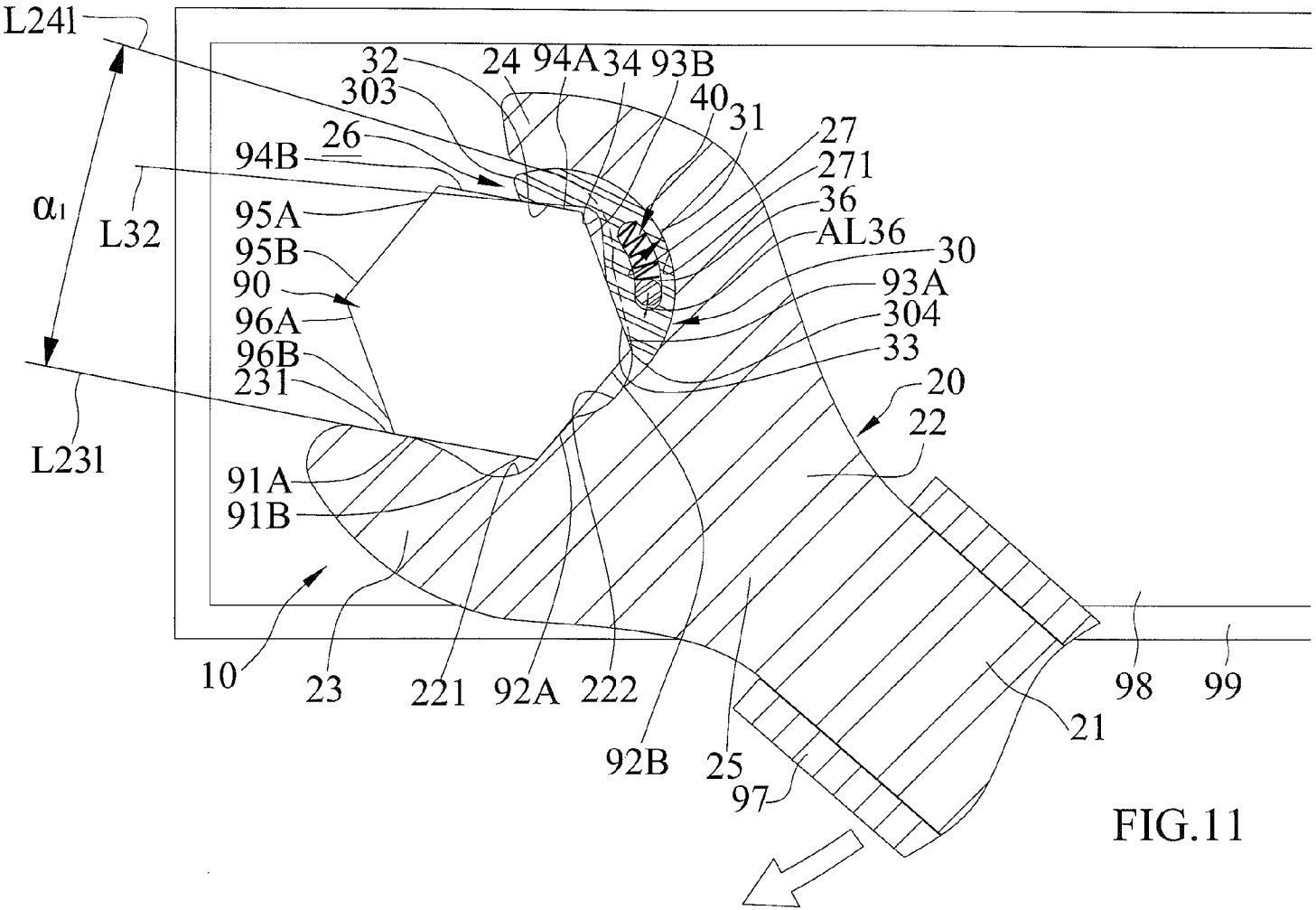
FIG. 11 shows a partial, cross sectional view illustrating further rotation of the open end wrench of FIG. 10 in the driving direction through use of an extension tube.
Figure 12:
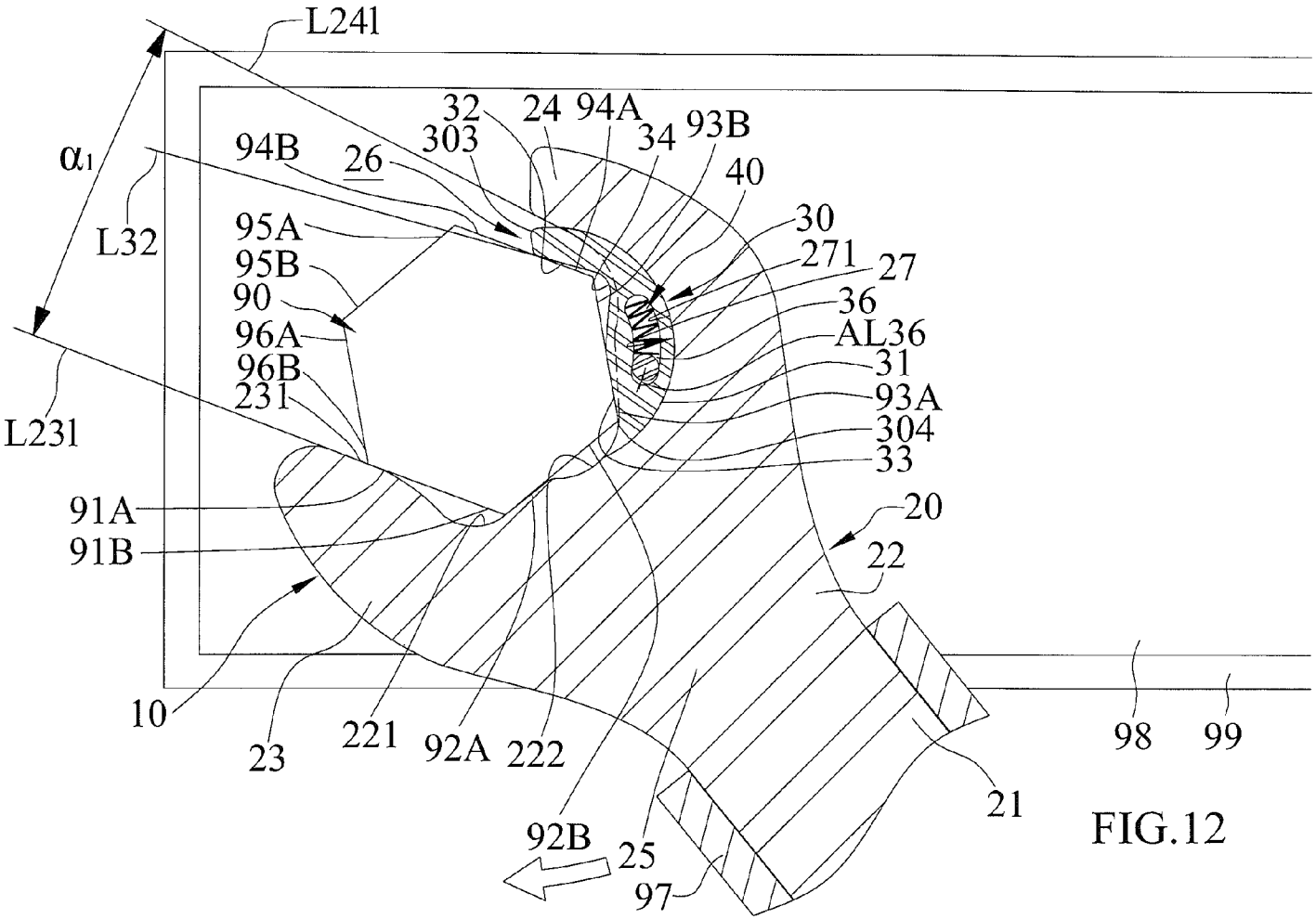
FIG. 12 shows a partial, cross sectional view illustrating further rotation of the open end wrench of FIG. 11 in the driving direction.

With reference to FIGS. 11 and 12, to further tighten workpiece 90, an extension tube 97 is engaged with handle 21 to provide an increased arm of force equal to or more than twice the original arm of force, providing double (or higher) toque with the same force.

When workpiece 90 is tightened to a certain extent by using extension tube 97, the reactive force imparted from workpiece 90 to jaw portion 22 increases and causes elastic deformation of jaw portion 22. Workpiece 90 no longer rotates together with open end wrench 10, and body 20 gradually rotates clockwise relative to workpiece 90. In this case, slide 30 does not rotate together with body 20 in the clockwise direction due to existence of buffering space 36. Thus, first end 303 of slide 30 remains in contact with fourth force-receiving face in the first rotating direction 94A of workpiece 90 while arc length AL36 of buffering space 36 reduces.

The opening space of jaw portion 22 increases (see opening spacing α1 in FIGS. 11 and 12) such that the stress acting on the deforming jaw portion 22 increases to resist deformation. When the stress resisting deformation of jaw portion 22 becomes larger than the reacting force from workpiece 90, jaw portion 22 no longer deforms. In this case, slide 30 can be driven again by jaw portion 22 to proceed with supper high-torque operation of open end wrench 10.

Then, the user rotates jaw portion 22 in the driving direction by using extension tube 97 to drive workpiece 90 to rotate about the axis of workpiece 90. The force applied by the user is transmitted to first force-receiving face in the first rotating direction 91A of workpiece 90 via force-applying face 231 of first jaw 23 and transmitted to fourth force-receiving face in the first rotating direction 94A of workpiece 90 via first end 303 of slide 30. Thus, workpiece 90 continues to rotate together with jaw portion 22, proceeding with super high-torque operation until workpiece 90 is tightened. During the operation, push face 251 of throat 25 abuts second force-receiving face in the first rotating direction 92A of workpiece 90 to assist in driving of workpiece 90. Workpiece 90 in FIG. 12 has been rotated 10° in the clockwise direction relative to first and second boards 98 and 99.

Figure 13:
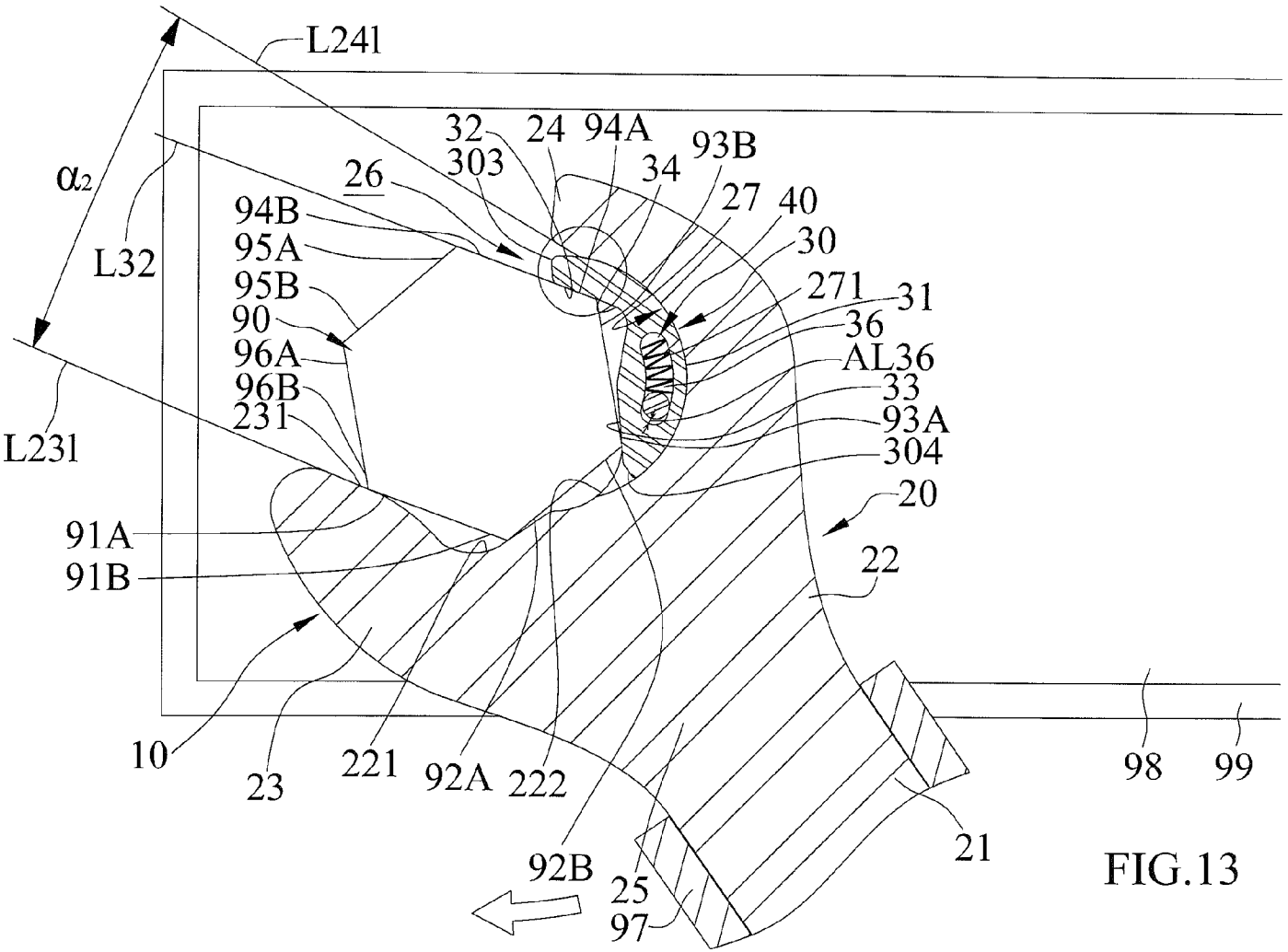
FIG. 13 shows a partial, cross sectional view illustrating further rotation of the open end wrench of FIG. 12 in the driving direction.
Figure 14:
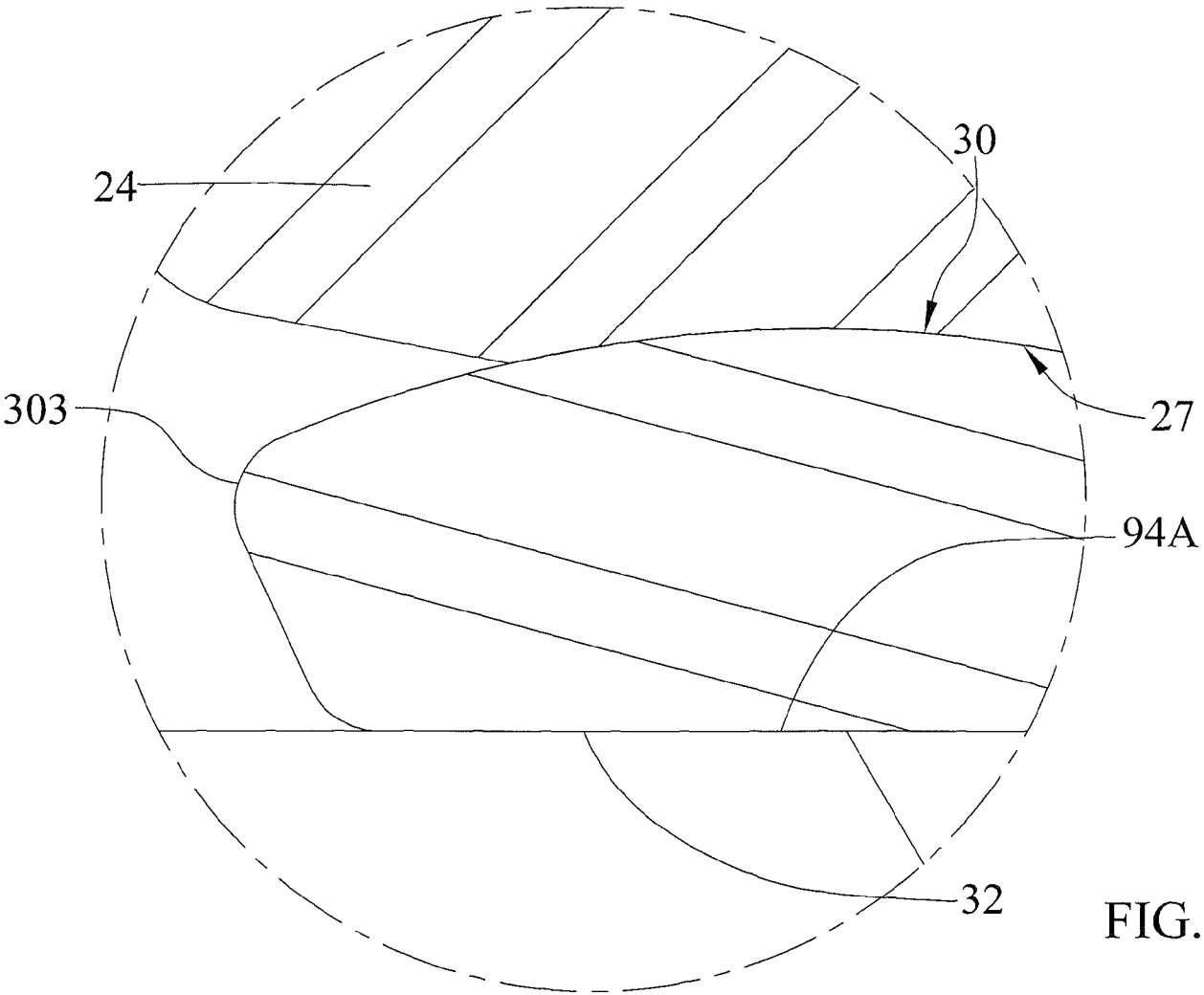
FIG. 14 shows an enlarged view of a circled portion in FIG. 13.

With reference to FIGS. 13 and 14, during tightening of workpiece 90, the reactive force from workpiece 90 also increases continuously. When the reactive force from workpiece 90 becomes larger than the stress resisting deformation of jaw portion 22, workpiece 90 stops again. In this case, the opening space of jaw portion 22 further increases due to elastic deformation of jaw portion 22 (see opening spacing α2 in FIG. 13) such that the stress acting on the deforming jaw portion 22 increases again to resist the deformation, and workpiece 90 does not rotate together with open end wrench 10. Body 20 and slide 30 gradually rotate relative to workpiece 90 in the clockwise direction while buffering angle θ reduces gradually.

Then, the stress acting on jaw portion 22 increases to continuously resist deformation of jaw portion 22. When the stress becomes larger than the reacting force from workpiece 90, jaw portion 22 no longer deforms. In this case, first wrenching face 32 of slide 30 abuts and is in surface contact with fourth force-receiving face in the first rotating direction of workpiece 90. Slide 30 can be driven again by jaw portion 22 to proceed with super high-torque operation of open end wrench 10.

Figure 15:
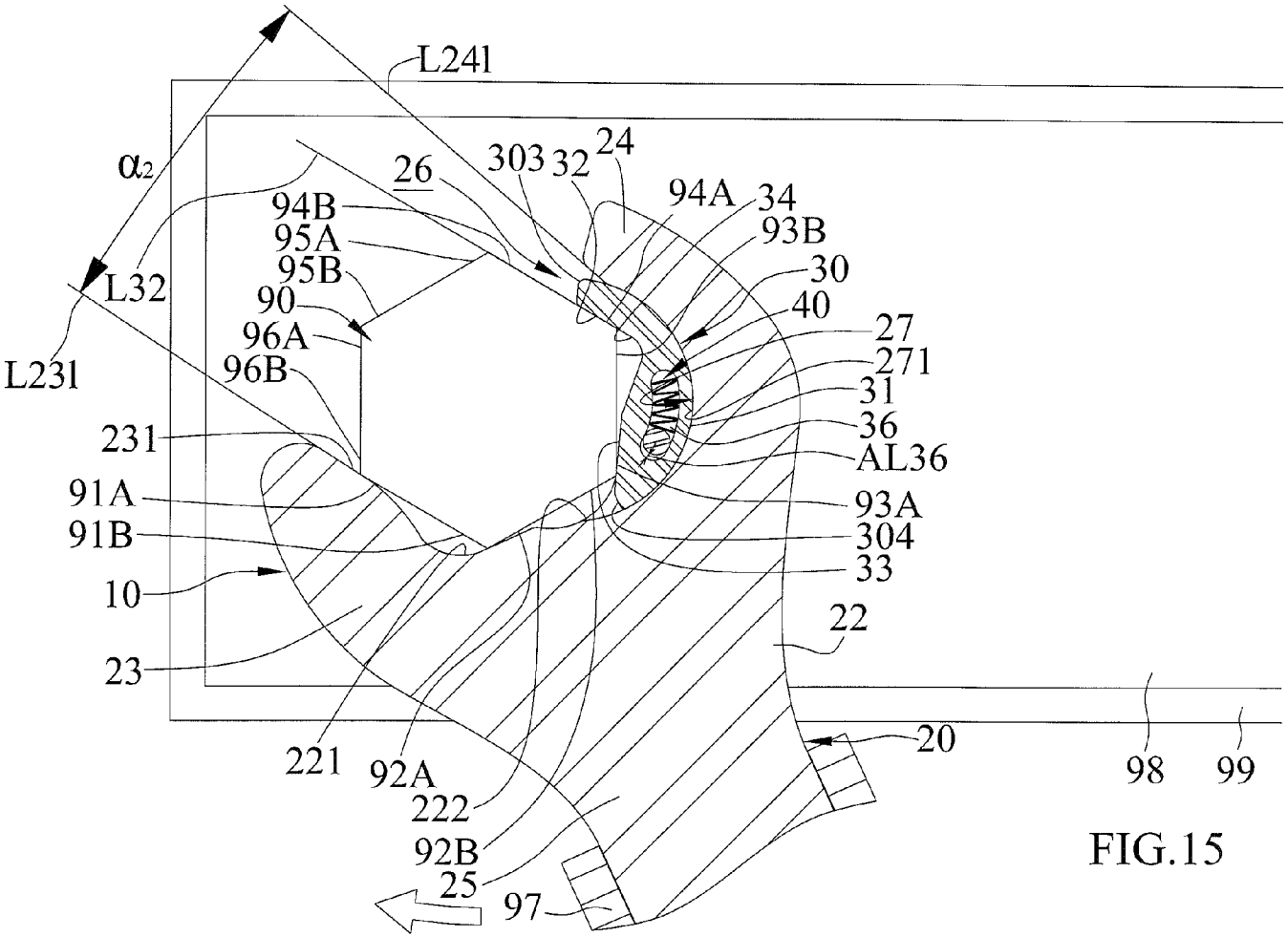
FIG. 15 shows a partial, cross sectional view illustrating further rotation of the open end wrench of FIG. 13 in the driving direction.

With reference to FIG. 15, the user rotates jaw portion 22 in the driving direction by using extension tube 97 to drive workpiece 90 to rotate about the axis of workpiece 90. The force applied by the user is transmitted to first force-receiving face in the first rotating direction 91A of workpiece 90 via force-applying face 231 of first jaw 23 and transmitted to fourth force-receiving face in the first rotating direction 94A of workpiece 90 via first wrenching face 32 of slide 30. Thus, workpiece 90 continues to rotate together with jaw portion 22, proceeding with super high-torque operation until workpiece 90 is tightened. Workpiece 90 in FIG. 15 has been rotated 10° in the clockwise direction relative to first and second boards 98 and 99. The operation continues until workpiece 90 is tightened.

In this embodiment, the timing of actuation of buffering space 36 prior to buffering angle θ is not limited to the driving procedures mentioned above. It can be appreciated that buffering angle θ can be actuated prior to buffering space 36 due to differing friction between workpiece 90 and slide 30. The above driving procedures are provided to assist in understanding the technique of the present invention. The same effect can be achieved through other driving procedures.

Figure 16:
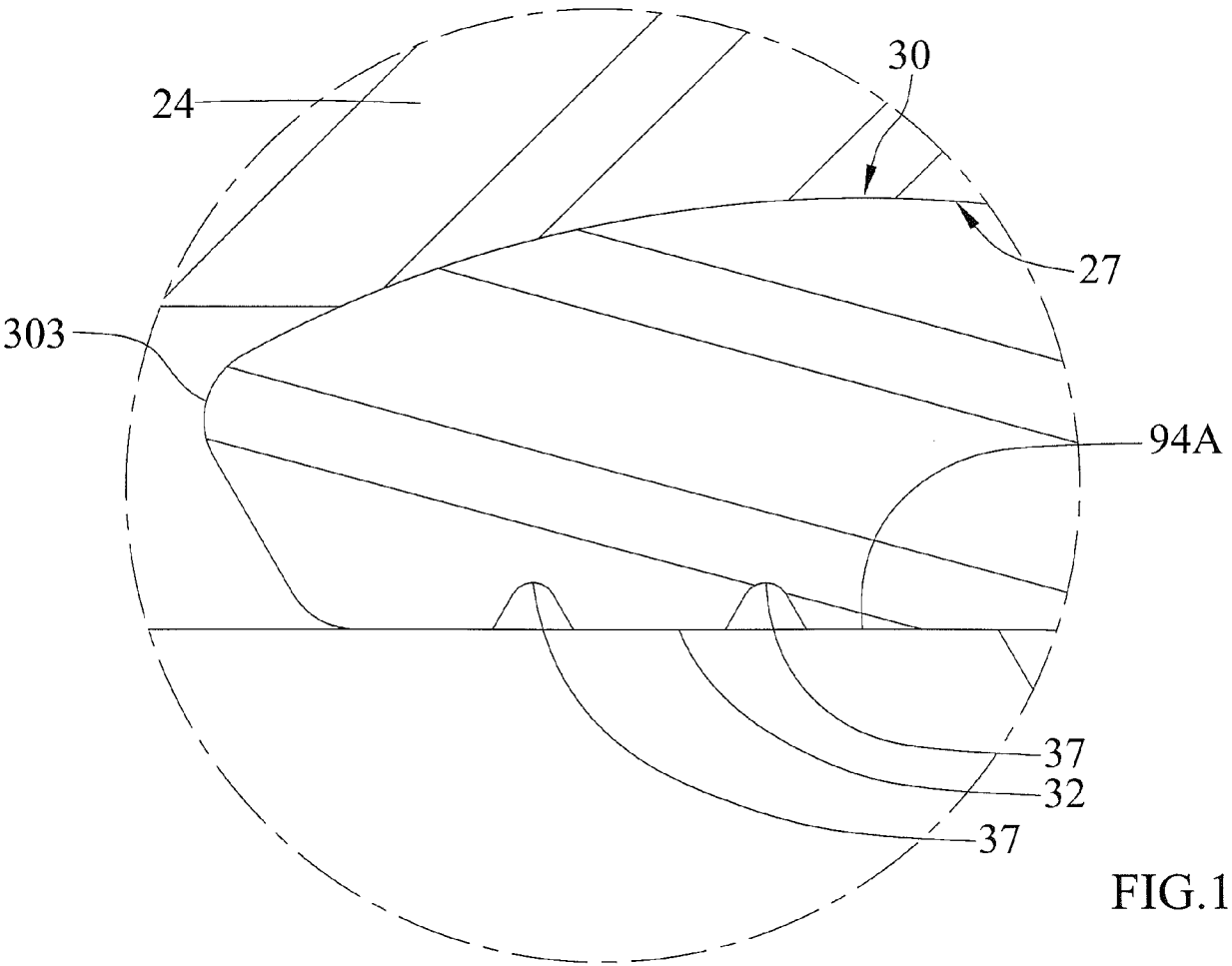
FIG. 16 shows an enlarged view of a portion of an open end wrench of a third embodiment according to the preferred teachings of the present invention.

FIG. 16 shows an open end wrench 10 of a third embodiment according to the preferred teachings of the present invention that is substantially the same as the first and second embodiments except that first wrenching face 32 of slide 30 includes at least one cavity 37 (two in this embodiment) having V-shaped cross sections. Cavities 37 increase friction between first wrenching face 32 of slide 30 and fourth force-receiving face in the first rotating direction 94A of workpiece 90, further increasing the driving torque to be higher than that in the first and second embodiments.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open end wrench capable of fast driving a workpiece, with the workpiece including first, second, third, fourth, fifth, and sixth sides respectively having first, second, third, fourth, fifth, and sixth force-receiving faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion including a throat intermediate the first and second jaws, with the throat and the first and second laws together defining a wrenching space adapted for receiving the workpiece, with the first law including a force-applying face facing the wrenching space and facing the second jaw, with the jaw portion further including an arcuate sliding groove formed in the second jaw and facing the wrenching space, with a guide fixed in the sliding groove;

a slide slideably received in the sliding groove, with the slide including opposite first and second ends, with the first end of the slide including a first wrenching face located outside of the sliding groove, with the slide further including an arcuate guiding slot with the guide received in the guiding slot, preventing the slide from disengaging from the sliding groove with the guiding slot including an abutting end, with the abutting end in contact with the guide when the slide is a free position; and an elastic device mounted between the body and the slide for returning the slide to the free position, wherein when the jaw portion is not engaged with the workpiece, the slide is in the free position, the first wrenching face of the slide is located in the wrenching space, the first wrenching face is not parallel to the force-applying face of the first jaw, and an extension line of the first wrenching face intersects an extension line of the force-applying face of the first jaw at a point away from the handle, wherein when the jaw portion receives the workpiece but does not drive the workpiece, the force-applying face of the first jaw abuts the first force-receiving face in the first rotating direction of the workpiece, the first end of the slide abutting the fourth force-receiving face in the first rotating direction of the workpiece, a buffering space is formed between the abutting end of the guiding slot and the guide, and the buffering space has an arc length, with the arc length of the buffering space being larger than half of the diameter of the guide, wherein when the jaw portion drives the workpiece and deforms elastically, the body rotates relative to the workpiece, the slide does not rotate together with the body due to the buffering space, and the buffering space allows the first end of the slide to abut the fourth force-receiving face in the first rotating direction of the workpiece when the jaw portion expands elastically.

2. The open end wrench as claimed in claim 1, wherein:

when the jaw portion receives the workpiece but does not drive the workpiece, the second end of the slide abuts the third force-receiving face in the first rotating direction of the workpiece such that the first wrenching face of the slide is parallel to the force-applying face of the first jaw, and the buffering space allows the force-applying face and the first wrenching face to respectively abut the first and fourth force-receiving faces in the first rotating direction of the workpiece when the jaw portion expands elastically.

3. The open end wrench as claimed in claim 1, with the second end of the slide including a second wrenching face located outside of the sliding groove, with the first wrenching face of the slide at an angle of 120° to the second wrenching face, and with the second wrenching face of the slide abutting the third force-receiving face in the first rotating direction of the workpiece and with the first wrenching face of the slide abutting the fourth force-receiving face in the first rotating direction of the workpiece when the jaw portion receives the workpiece but does not drive the workpiece, wherein the buffering space allows the force-applying face and the first wrenching face to respectively abut the first and fourth force-receiving faces in the first rotating direction of the workpiece when the jaw portion expands elastically.

4. The open end wrench as claimed in claim 1, wherein:

when the jaw portion receives the workpiece but does not drive the workpiece, a buffering angle is formed between the first wrenching face of the slide and the fourth force-receiving face in the first rotating direction of the workpiece, and the buffering angle allows the body and the slide to gradually rotate relative to the workpiece when the jaw portion expands elastically, abutting the first wrenching face of the slide against the fourth force-receiving face in the first rotating direction of the workpiece and providing surface contact between the first wrenching face of the slide and the fourth force-receiving face in the first rotating direction of the workpiece.

5. The open end wrench as claimed in claim 4, with the buffering angle being larger than 2°.

6. The open end wrench as claimed in claim 4, with the second end of the slide including a second wrenching face located outside of the sliding groove, with the first wrenching face of the slide being at an angle less than 118° to the second wrenching face.

7. The open end wrench as claimed in claim 1, with the first wrenching face of the slide including at least one cavity having a V-shaped cross section, with said at least one cavity adapted to increase friction between the first wrenching face of the slide and the fourth force-receiving face in the first rotating direction of the workpiece.

8. An open end wrench capable of fast driving a workpiece, with the workpiece including first, second, third, fourth, fifth, and sixth sides respectively having first, second, third, fourth, fifth, and sixth force-receiving faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion including a throat intermediate the first and second jaws, with the throat and the first and second jaws together defining a wrenching space adapted for receiving the workpiece, with the first jaw including a force-applying face facing the wrenching space and facing the second jaw, with the jaw portion further including an arcuate sliding groove formed in the second jaw and facing the wrenching space, with a guide fixed in the sliding groove;

a slide slideably received in the sliding groove, with the slide including opposite first and second ends, with the first end of the slide including a first wrenching face located outside of the sliding groove, with the slide further including an arcuate guiding slot, with the guide received in the guiding slot, preventing the slide from disengaging from the sliding groove, with the guiding slot including an abutting end, with the abutting end in contact with the guide when the slide is a free position; and an elastic device mounted between the body and the slide for returning the slide to the free position, wherein when the jaw portion is not engaged with the workpiece, the slide is in the free position, the first wrenching face of the slide is located in the wrenching space, the first wrenching face is not parallel to the force-applying face of the first jaw, and an extension line of the first wrenching face intersects an extension line of the force-applying face of the first jaw at a point away from the handle, wherein when the jaw portion receives the workpiece but does not drive the workpiece, the force-applying face of the first jaw abuts the first force-receiving face in the first rotating direction of the workpiece, the first end of the slide abuts the fourth force-receiving face in the first rotating direction of the workpiece, and a buffering angle is formed between the first wrenching face of the slide and the fourth force-receiving face in the first rotating direction of the workpiece, with the buffering angle being larger than 2°, and wherein when the jaw portion drives the workpiece to rotate and deforms elastically, the body rotates relative to the workpiece, and the buffering angle allows the body and the slide to gradually rotate relative to the workpiece such that the first wrenching face of the slide abuts the fourth force-receiving face in the first rotating direction of the workpiece, providing surface contact between the first wrenching face of the slide and the fourth force-receiving face in the first rotating direction of the workpiece.

9. The open end wrench as claimed in claim 8, with the second end of the slide including a second wrenching face located outside of the sliding groove, with the first wrenching face of the slide being at an angle less than 118° to the second wrenching face.

10. The open end wrench as claimed in claim 8, with the sliding groove including spaced, first and second support walls and an arcuate sliding wall extending between the first and second support walls, with the sliding wall being free of holes, grooves, and recesses and having an arcuate face, with the guide having two ends fixed in the first and second support walls, with the slide including an arcuate sliding face slideable along the sliding wall of the sliding groove, with the sliding face being free of holes, grooves, and recesses, with the slide further including a top face and a bottom face, with the guiding slot extending from the top face through the bottom face, with the guiding slot being free of holes, grooves, and recesses, with the guiding slot having a pressing end opposite to the abutting end, and with two ends of the elastic device respectively abutting the guide and the pressing end of the guiding slot.

11. The open end wrench as claimed in claim 10, with the slide further including an evasive portion between the first and second wrenching faces, with the evasive portion of the slide adapted to allow entrance of the third force-receiving face in the second rotating direction of the workpiece.

12. The open end wrench as claimed in claim 10, with the sliding face of the slide having a first curvature, with the sliding wall of the sliding groove having a second curvature equal to the first curvature, with the sliding face of the slide smoothly slideable along the sliding wall of the sliding groove, and with the sliding face adapted to transmit reactive force from the workpiece to the sliding wall and to avoid concentration of stress on the slide, increasing torque bearing capacity of the slide when the workpiece is driven by the body to rotate.

13. The open end wrench as claimed in claim 12, with the guiding slot having a third curvature equal to the second curvature, allowing relative smooth, arcuate sliding between the guiding groove of the slide and the guide in the sliding groove without operational interference therebetween.

14. The open end wrench as claimed in claim 10, with the top face of the slide in sliding contact with the first support wall of the sliding groove, with the bottom face of the slide in sliding contact with the second support wall of the sliding groove, with the top and bottom faces symmetrically supported by the first and second support walls, avoiding wobbling of the slide while the slide is sliding in the sliding groove and increasing operational stability of the open end wrench.

15. The open end wrench as claimed in claim 10, with the first and second jaws and the jaw portion integrally formed as a single and inseparable component of a same material.

16. The open end wrench as claimed in claim 10, with the throat including a push face facing the wrenching space, with the push face being at an angle of 120° to the force-applying face of the first jaw, and with the push face of the throat adapted to correspond to the second force-receiving face in the first rotating direction of the workpiece.

17. The open end wrench as claimed in claim 16, with the second jaw including first and second faces, with the first face of the second jaw facing the wrenching space and the throat, with the second face of the second jaw facing the wrenching space and a distal end of the first jaw, with the first face of the second jaw being at an angle of 120° to the second face of the second jaw, with the first and second faces adapted to correspond respectively to the fourth and third force-receiving faces in the first rotating direction of the workpiece, with the first face of the second jaw being parallel to the force-applying face of the first jaw, with a first evasive portion formed between the force-applying face of the first jaw and the push face of the throat, with the first evasive portion adapted to allow entrance of the first force-receiving face in the second rotating direction of the workpiece, with a second evasive portion formed between the push face of the throat and the second face of the second jaw, with the first evasive portion adapted to allow entrance of the second force-receiving face in the second rotating direction of the workpiece, with the jaw portion further including a third evasive portion between first and second faces of the second jaw, and with third evasive portion adapted to allow entrance of the third force-receiving face in the second rotating direction of workpiece.

18. The open end wrench as claimed in claim 10, with the elastic device including an elastic element received in the guiding slot, with the first and second support walls of the sliding groove being parallel to each other and having a spacing therebetween, with the top and bottom faces of the slide parallel to each other and having a height in a height direction of the slide equal to the spacing between the first and second support walls, with the guiding slot of the slide having a height in the height direction of the slide equal to the height of the slide, with the guiding slot having a width in a width direction perpendicular to the height direction of the guiding slot, with the width of the guiding slot equal to a diameter of the guide, with the height of the guiding slot being larger than 1.5 times the width of the guiding slot, with the elastic element received in the guiding slot having a height in the height direction of the slide, with the height of the elastic element being not larger than the width of the guiding slot but larger than 0.5 times the width of the guiding slot, with the elastic element being a resilient plate having first and second ends and having Z-shaped cross sections, with a plurality of force-storing units provided between the first and second ends of the elastic element, with each of the plurality of force-storing units being a metal plate having substantially V-shaped cross sections, with each of the plurality of force-storing units including first and second legs and a compression section between the first and second legs, with the compression section storing energy when the first and second legs are compressed, providing the force-storing unit with an elastic returning function, with the first leg of each of the plurality of force-storing units connected to the second leg of an adjacent one of the plurality of force-storing units such that the compression section of each of the plurality of force-storing units possesses the elastic returning function, with the first leg on the first end of the elastic element abutting the guide, and with the second leg on the second end of the elastic element abutting the pressing end of the guiding slot.

* * * * *